US008784035B2

(12) United States Patent
Blackstone

(10) Patent No.: US 8,784,035 B2
(45) Date of Patent: Jul. 22, 2014

(54) BLADELESS FLUID PROPULSION PUMP

(76) Inventor: Ralf W. Blackstone, Clearwater, FL (US)

( * ) Notice: Subject to any disclaimer, the term of this patent is extended or adjusted under 35 U.S.C. 154(b) by 1188 days.

(21) Appl. No.: 12/599,776

(22) PCT Filed: May 15, 2008

(86) PCT No.: PCT/US2008/006231

§ 371 (c)(1), (2), (4) Date: Oct. 19, 2010

(87) PCT Pub. No.: WO2008/143932

PCT Pub. Date: Nov. 27, 2008

(65) Prior Publication Data

US 2011/0038707 A1 Feb. 17, 2011

Related U.S. Application Data

(60) Provisional application No. 60/930,472, filed on May 16, 2007.

(51) Int. Cl.
*F04D 17/08* (2006.01)

(52) U.S. Cl.
USPC ..... 415/90; 415/206; 415/229

(58) Field of Classification Search
USPC ..... 415/90, 206, 229
See application file for complete search history.

(56) References Cited

U.S. PATENT DOCUMENTS

| | | | | |
|---|---|---|---|---|
| 1,061,142 | A | 5/1913 | Tesla | |
| 3,275,223 | A * | 9/1966 | Fowell | 415/53.1 |
| 4,403,911 | A | 9/1983 | Possell | |
| 5,191,247 | A * | 3/1993 | Possell | 310/62 |
| 5,192,183 | A * | 3/1993 | Wilkinson | 415/90 |
| 5,388,958 | A * | 2/1995 | Dinh | 415/90 |
| 6,368,078 | B1 | 4/2002 | Palumbo | |
| 6,692,232 | B1 * | 2/2004 | Letourneau | 416/198 R |
| 7,108,488 | B2 * | 9/2006 | Larue et al. | 417/407 |
| 7,677,041 | B2 * | 3/2010 | Woollenweber | 60/608 |
| 2005/0214109 | A1 | 9/2005 | Grande, III et al | |

FOREIGN PATENT DOCUMENTS

EP 0 846 884 B1 2/2003

* cited by examiner

*Primary Examiner* — Ninh H Nguyen
(74) *Attorney, Agent, or Firm* — Jackson Walker, LLP

(57) ABSTRACT

A bladeless pump for fluids, such as gases that may contain particulate matter, drivable by a motor, consisting of an assembly of rotors or discs stacked against each other. Each rotor/disc has a runner portion on an outer area separated from its center, and a central portion having two or more spokes, divided by openings. The spokes are typically thicker than the rest of the discs. When many discs are placed together and spun on a motor-driven axle, air may be drawn in adjacent the rotor assembly, to the inter-disc openings, and compressed as it enters the area A spiral-shape volute is provided adjacent the outer πM of the disc assembly, receiving pressurized air and releasing it from a motor housing. Applicant's bladeless pump may include a base for receiving the rotor housing and the motor, which may include a housing to substantially enclose the motor and its housing.

11 Claims, 29 Drawing Sheets

Dual-Broached Round Shaft

Cross-Section thru Turbine Housing

Multi-Stage Pump

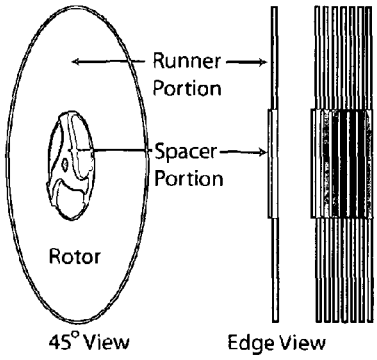
Fig. 21
High-Pressure Rotor Configuration
Standard Rotor
Fig. 21a
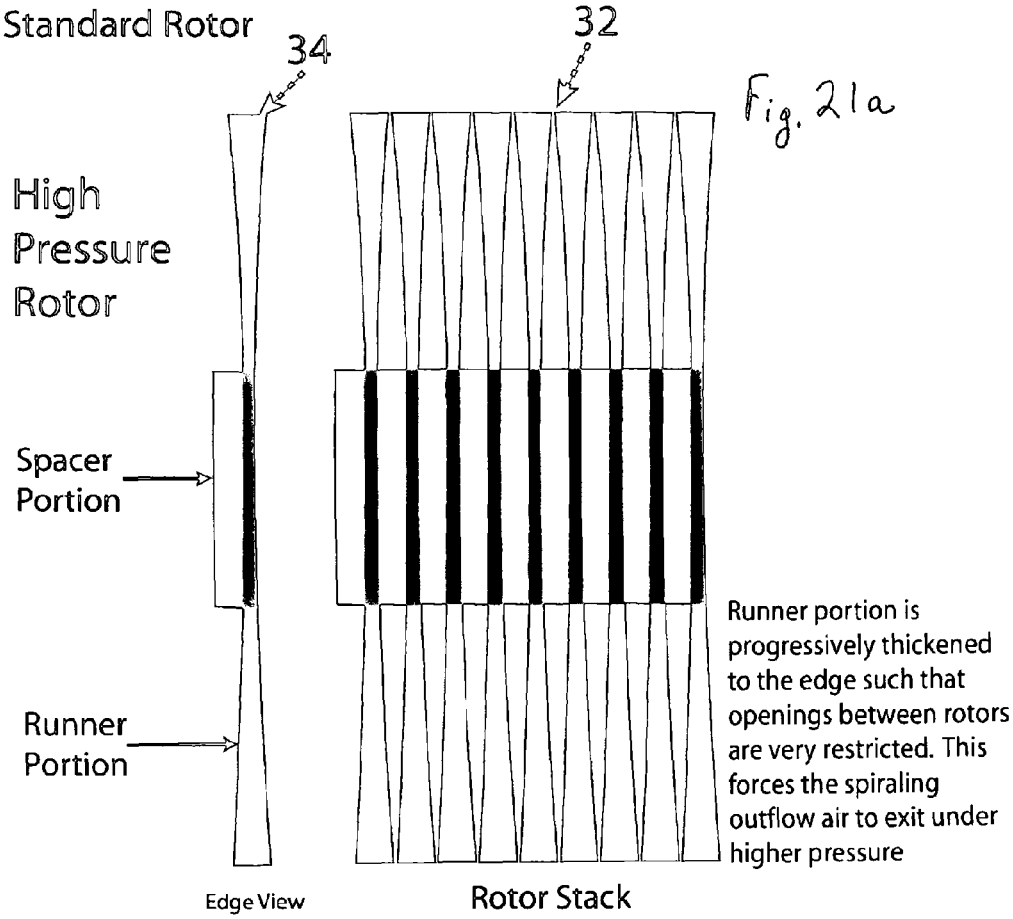

BLADELESS FLUID PROPULSION PUMP

This is a utility patent application claiming priority from and incorporating by reference U.S. Provisional Application Ser. No. 60/930,472, filed May 16, 2007.

FIELD OF THE INVENTION

A fluid propulsion pump, more specifically, a bladeless fluid propulsion pump.

BACKGROUND

Most pumps use blades to impart energy to molecules of a fluid, such as a gas or liquid. However, some pumps are directed to the application of mechanical power to a fluid without the use of blades. One such bladeless pump is disclosed in U.S. Pat. No. 1,061,142 (Tesla 1913, incorporated herein by reference, see FIGS. 1*a* and 1*b*). Tesla discloses the use of a series of parallel motor driven, closely spaced, rotors or discs, the spinning of which causes a fluid introduced near the center to be propelled outward across a surface of a disc through the adhesion of the fluid at the surface of the disc. Such a device will generally be hereinafter referred to as a bladeless pump.

OBJECTS OF THE INVENTION

It is the object of this invention to provide a high efficiency, bladeless pump capable of high r.p.m. This pump is also capable of propelling particulate-laden fluids without damage to the pump.

SUMMARY OF THE INVENTION

A bladeless fuel pump having a variety of unique features, alone or in combination, which provide an improvement over prior art bladeless pumps, especially at high r.p.m.

Applicant's bladeless pump comprises a rotary housing, including walls defining a volute having a knife edge, a volute fluid outlet, and walls defining a rotor feed opening. The rotor assembly includes a multiplicity of rotors, each having a runner portion, the runner portion having a first thickness T1. A multiplicity of spokes are included as part of the rotors, the spokes including walls defining an axle opening. The spokes have a thickness T2 that is greater than the thickness of the runner portion T1. A pair of endplates, an axle, and a retaining collar may further be included in Applicant's bladeless pump, in a preferred embodiment.

An alternate preferred embodiment provides the spokes with alignment locking means and the rotor assembly may include a pair of endplates that may be dimensioned different, for example, thicker, than the rotors or the multiplicity of rotors.

The alignment locking means may include projecting pins in the receiving indentations. These projecting pins may all have the same shape or may have different shapes, with the corresponding indentation shaped to receive the specific pin. The rotors may also include standoffs, including a multiplicity of sets of standoffs for exact spacing between the runner portions at speed.

The axle may have a polygonal shape with faceted, broached or radius corners. On the other hand, the axle may be round and have a keyway corresponding to a keyway in the axle opening, a key for engaging the keyway of the axle and the keyway of the axle opening so rotors and/or endplates are engaged with the axle to rotate therewith.

The axle may be fused with the rotors as by using an adhesive, such as glue, to both glue the rotors together and to the axle or as by, for example, welding. When so fused, collars do not have to be used as the rotor assembly will not migrate axially when fused.

The rotors may be made of plastic, ceramic, or metal and made by injection molding, stamping, or similar manufacturing process. The end-plates may be plain or conical shaped, flat (planar) or other suitable shape. The endplates may also be connected to a locking retainer collar and may or may not have fan shaped struts. The locking retainer collar would maintain the rotor assembly in the compression. The walls defining the rotor feed opening may be radiused or without a radiused edge.

Passageway walls carry a fluid, such as a gaseous fluid, from a fluid inlet to a rotor feed opening, and these walls may be curved to accelerate the air as it moves from the fluid inlet to the rotor feed opening.

A motor may be provided to drive the rotor assembly, the motor may include bearings to align the axle with the rotor housing and the rotor assembly. The bearings may be plane bearings, ball bearings, air bearings and the like. The bearings may or may not be spaced apart from the rotor feed openings and may take a variety of configurations, including vortex or straight. Transition bearings may also be provided.

A cover and a base may be provided; the base for engagement with the rotor housing and the motor and bearing standards. Bearing standards and motor standards may be provided to support the axle and motor and to precisely position the rotor stack against the knife edge in the rotor housing.

There may be means, including a tube or channel for carrying high pressure air from the rotor housing to the motor and/or bearings to help cool the same. Likewise, the housing may be sealed tightly with rubber ridges for a fluid tight seal, but there may be provided openings wherein a high pressure gas cooling the motor may exit the housing away from or opposite the motor. Bearing standards and motor standards may be provided to support the axle and motor.

BRIEF DESCRIPTION OF THE DRAWINGS

FIG. 12*a* also indicates with arrows air flow from the volute to the air bearings. FIG. 12*b* also illustrates the manner in which air flow may be provided to the air bearings and also to the motor to cool the motor's rotor and stator.

FIG. 13 also illustrates with arrows an assembly by which air can be directed under pressure from the turbine rotor through or past the motor and exhausted from a vent in the cover, such air flow designed to help cool the motor.

FIG. 15 is shown with the cover removed.

FIG. 19 illustrates a multi-stage pump.

FIGS. 21 and 21A illustrate cross-sectional views of an alternate preferred embodiment of the rotor stack showing runner portion progressively thickening to the edge such that openings between the adjacent rotors are restricted.

DETAILED DESCRIPTION OF THE PREFERRED EMBODIMENTS

Figure 1B:
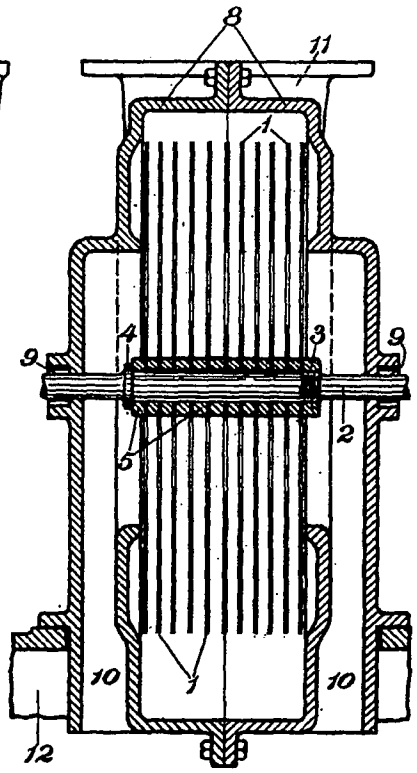
FIGS. 1*a* and 1*b* illustrate a prior art bladeless pump as disclosed by the Tesla patent.
Figure 1A:
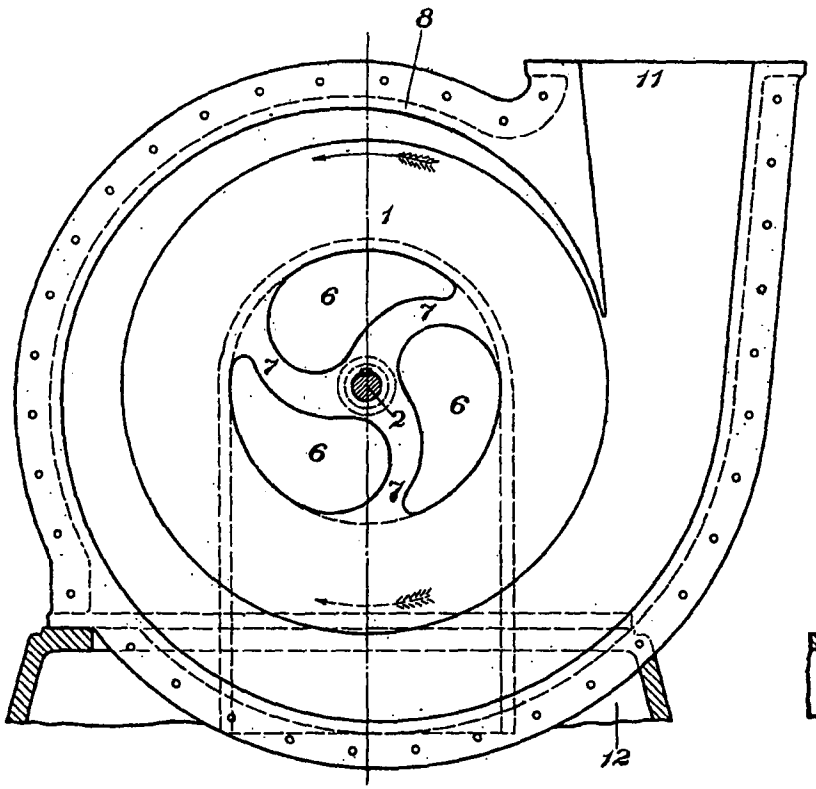

FIGS. 2*a*, 2*b*, 2*c*, 3, and 4 illustrate a bladeless pump 10 comprising typically: a rotor housing 12, including inner walls 13 (see FIG. 6*c*), the rotor housing including walls defining a spiral volute 14, the walls defining the volute also disclosing a knife edge 16 and a volute fluid outlet 18. Rotor housing 12 further includes walls defining a rotor feed opening 20, walls may be radiused to help maintain laminar fluid flow into rotor feed opening 20. The knife edge may be about 0.5 mil. (optimal) off the outer edge of the rotors 34, or in the range of 0.001 mil. to 250 mil. At speed, the rotor stack should not make contact with the knife edge of the volute.

Fluid inlet walls 24 which may be part of or engaged with a support base 15 include walls defining a fluid inlet 26 and fluid passageway walls 28 for carrying a fluid, such as a gas or liquid, from the fluid inlet 26 to the rotor feed opening 20.

Figure 2A:
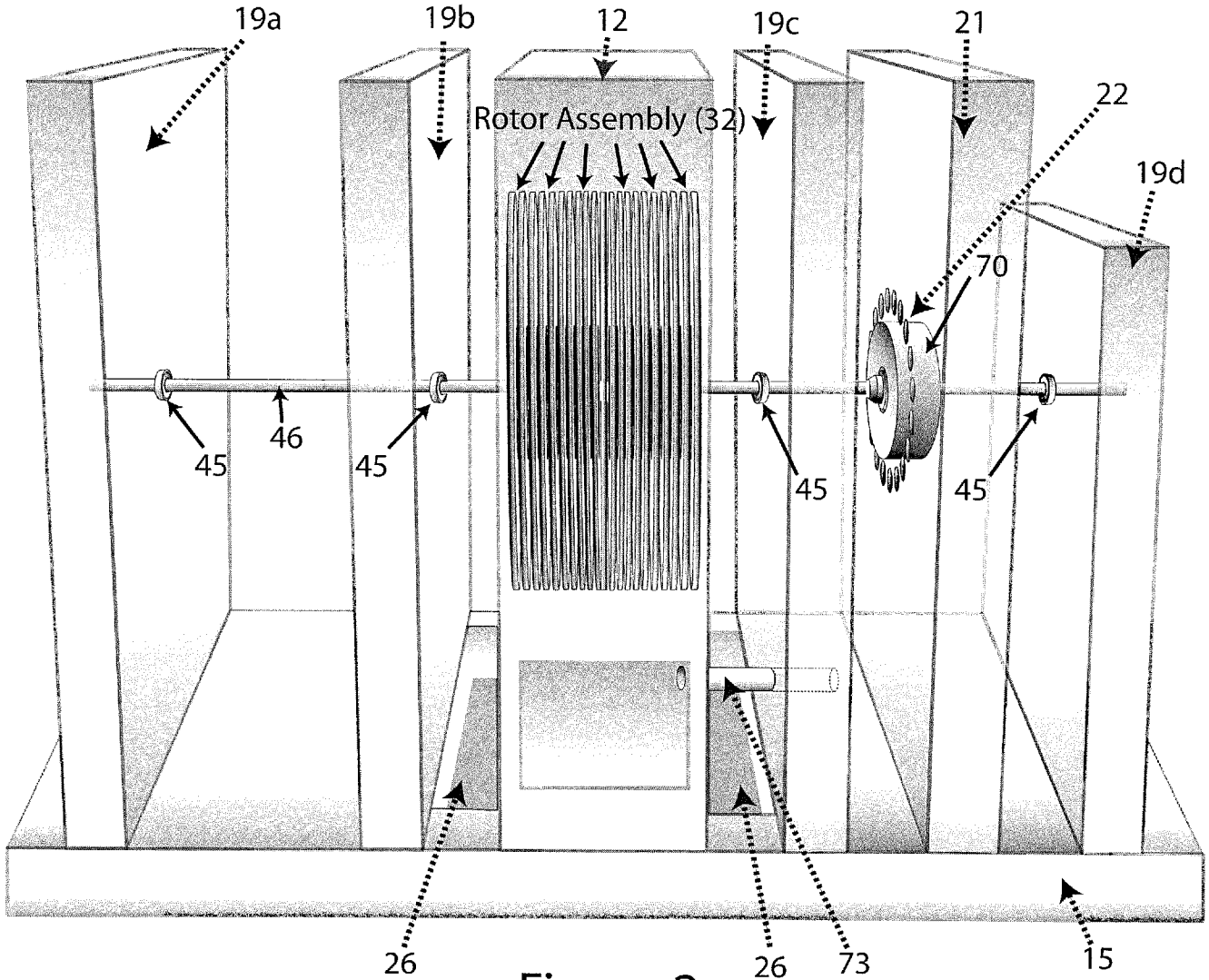
FIGS. 2*a*, 2*b*, and 2*c* are illustrations of embodiments in perspective and elevational views of Applicant's invention.
Figure 2B:
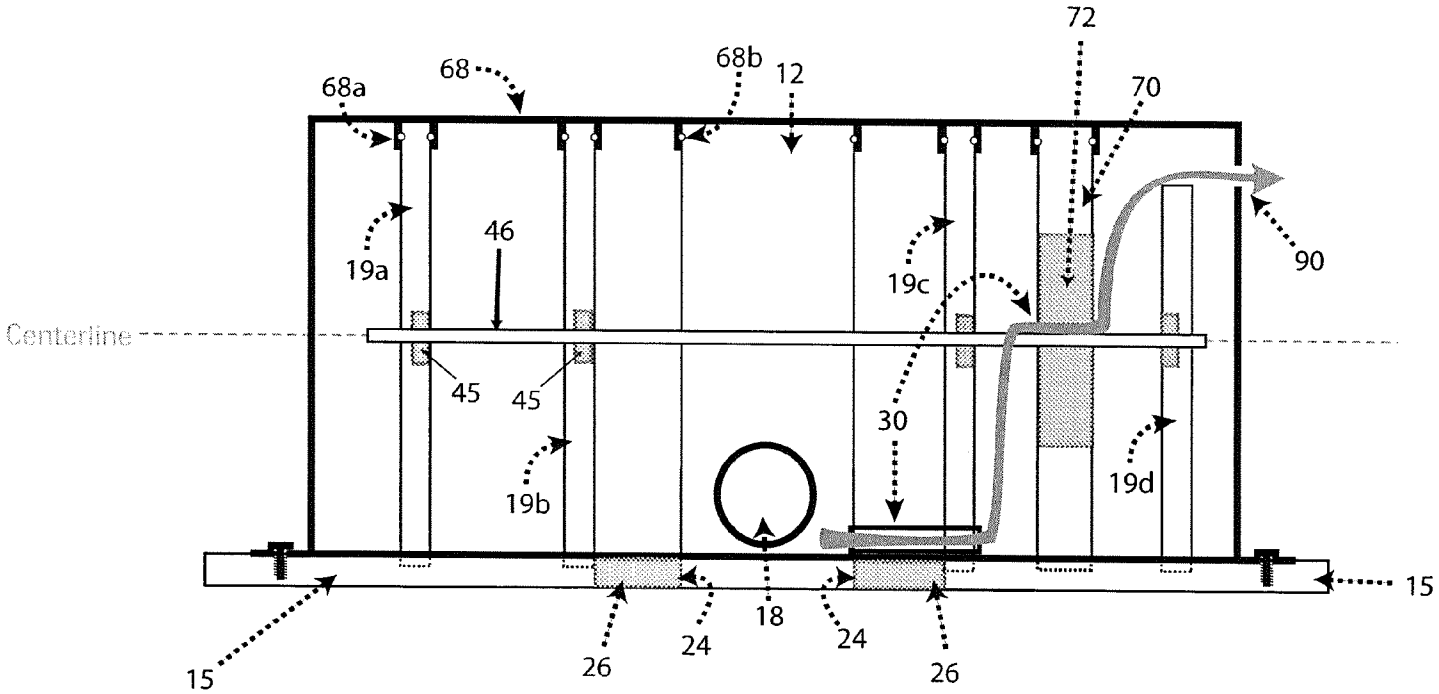
Figure 2C:
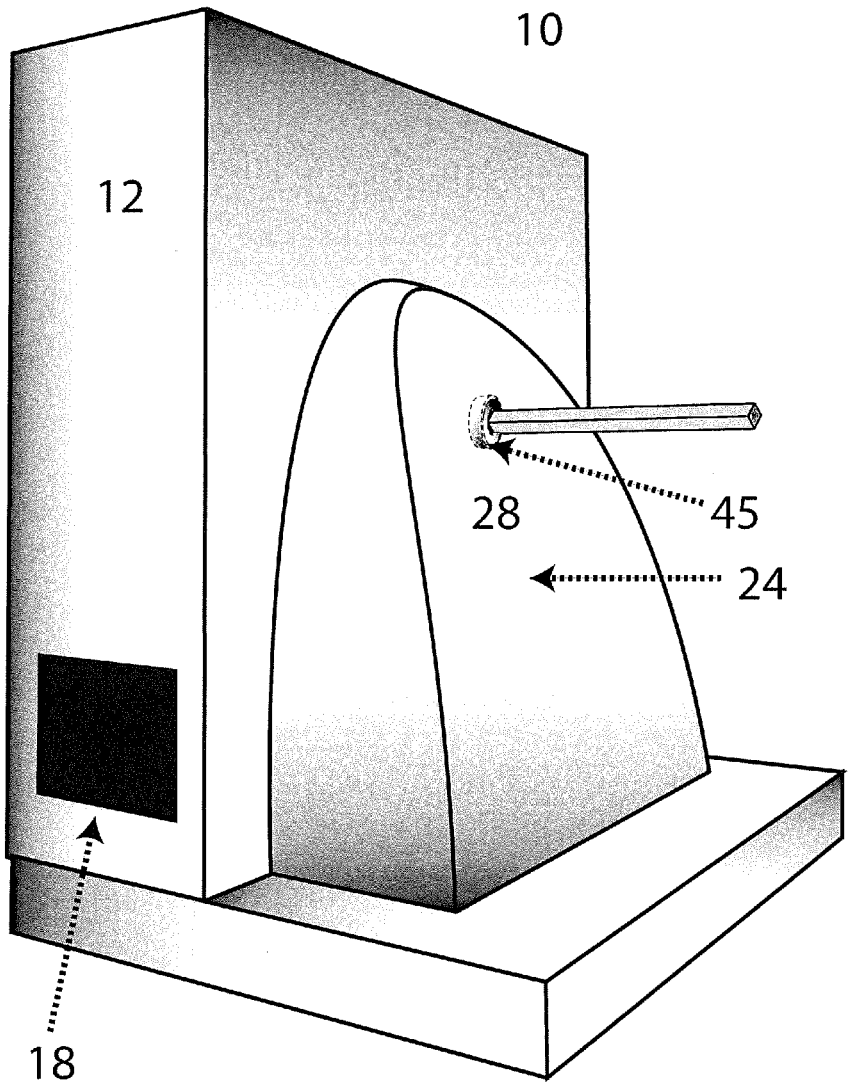
Figure 3:
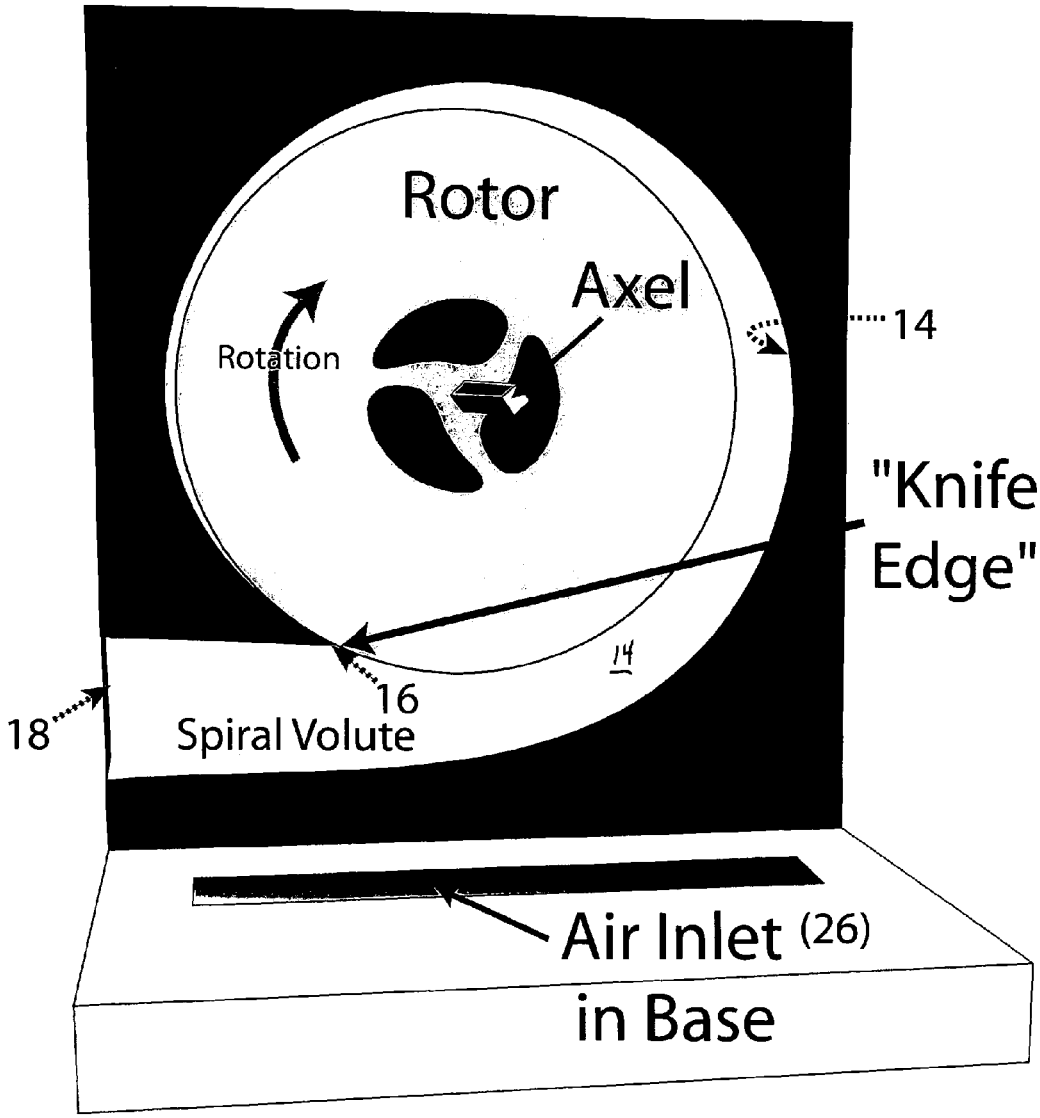
FIG. 3 is a cross-sectional perspective view through the rotor housing and stack assembly of Applicant's present invention showing the base air inlet and spiral volute.

FIG. 2*c* illustrates the use of fluid passageway walls 28 in which the cross-sectional profile area decreases as air is carried from the fluid inlet 26 to rotor feed opening 20. Fluid passageway walls 28 may also have a spiral shape with or without decreasing cross-sectional profile area to impart a vortex motion to the incoming air as it is delivered to and enters rotor feed opening 20. This may provide for more efficient feeding of air to the stack assembly 50.

Typically, the spokes 40 of the central opening of the disc line up such that the rotor central openings 38 also line up as a straight line. In an alternate embodiment, projecting pins 54 and their receiving indentions 56 are altered in their placement (slightly offset on the spoke) such that rotor central openings now describe a helical path to the central disc rotor in the rotor assembly 32 from both edges of this rotor assembly 32, this helical path oriented to the plane of disc rotation at speed. This way the rotor assembly 32 uses its spokes 40 to describe a helical path (much like the edges of a twist drill) from both sides of the rotor assembly 32 that then aids ingestion of air into the rotor assembly 32. Typically, a left-hand twist would be on one side and a right-hand twist on the other, which would meet in the middle. This should improve the efficiency of air ingestion into the disc rotors and thus overall efficiency of the turbine.

Figure 5:
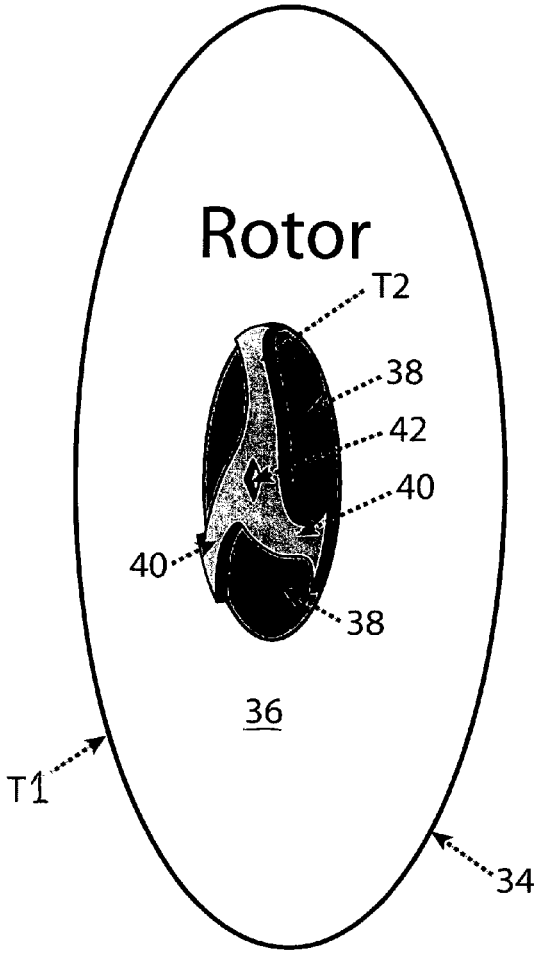
FIG. 5 illustrates a rotor including the runner portion and the spokes and the thickness relationships between the two.
Figure 5A:
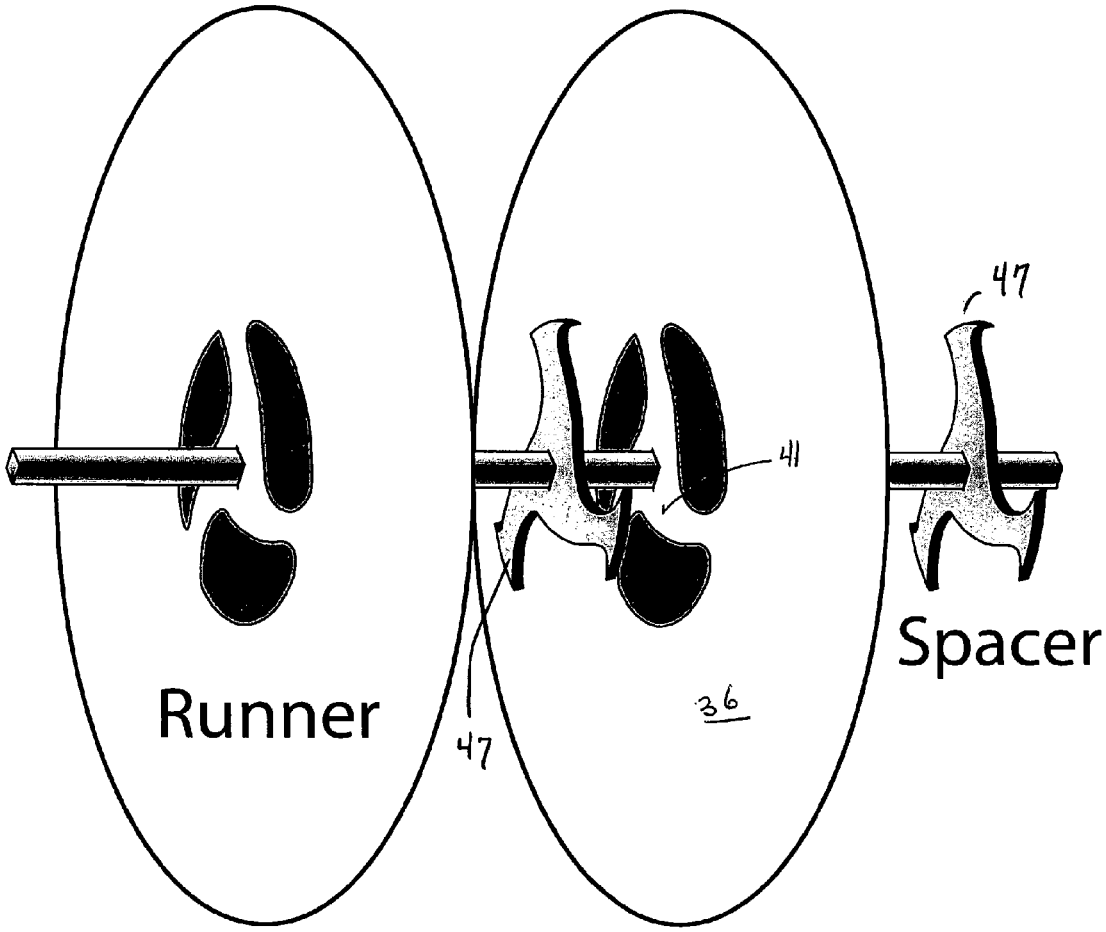
FIG. 5*a* illustrates in perspective view the manner in which runners and spacers may be produced as separate elements and engaged on the shaft.

As illustrated in FIGS. 2*a*, 6*a*-*c*, 17, and 21, Applicant's bladeless pump 10 is seen to include: a rotor assembly 32, the rotor assembly 32 having a multiplicity of disc-shaped substantially parallel rotors 34. As seen in FIGS. 5 and 5*a*, each rotor 34 includes a runner portion 36. The runner portion 36 typically has a first thickness T1. Each rotor also has walls defining a multiplicity of central openings 38, transcribed by a multiplicity of spokes 40 as part of a spoke section 41, the spokes meeting at walls defining an axle opening 42. The spokes have a second thickness T2. The second thickness T2 is typically greater than the first thickness T1, the thickness difference defines the inter-runner spacing.

With reference to the above, it is seen that the rotor housing 12 locates rotor assembly 32 in a manner which maintains the parallel alignment of the multiple rotors to each other along with the alignment of the rotor assembly 32 within the spiral volute and adjacent rotor feed opening 20 in such a manner so that there is minimum fluid seepage into the interior of the rotor housing, except through fluids (gases) passing through rotor feed opening 20. As the rotor assembly spins, air or other fluid is drawn through the fluid inlet 26 into the rotor feed opening 20 and into the rotor central openings, under a low pressure. Energy is provided to the fluid by the spinning rotors that will accelerate the fluid molecules into spiral volute 14 and out volute fluid outlet 18. Feed opening 20 may be radiused (see FIG. 4).

Figure 6A:
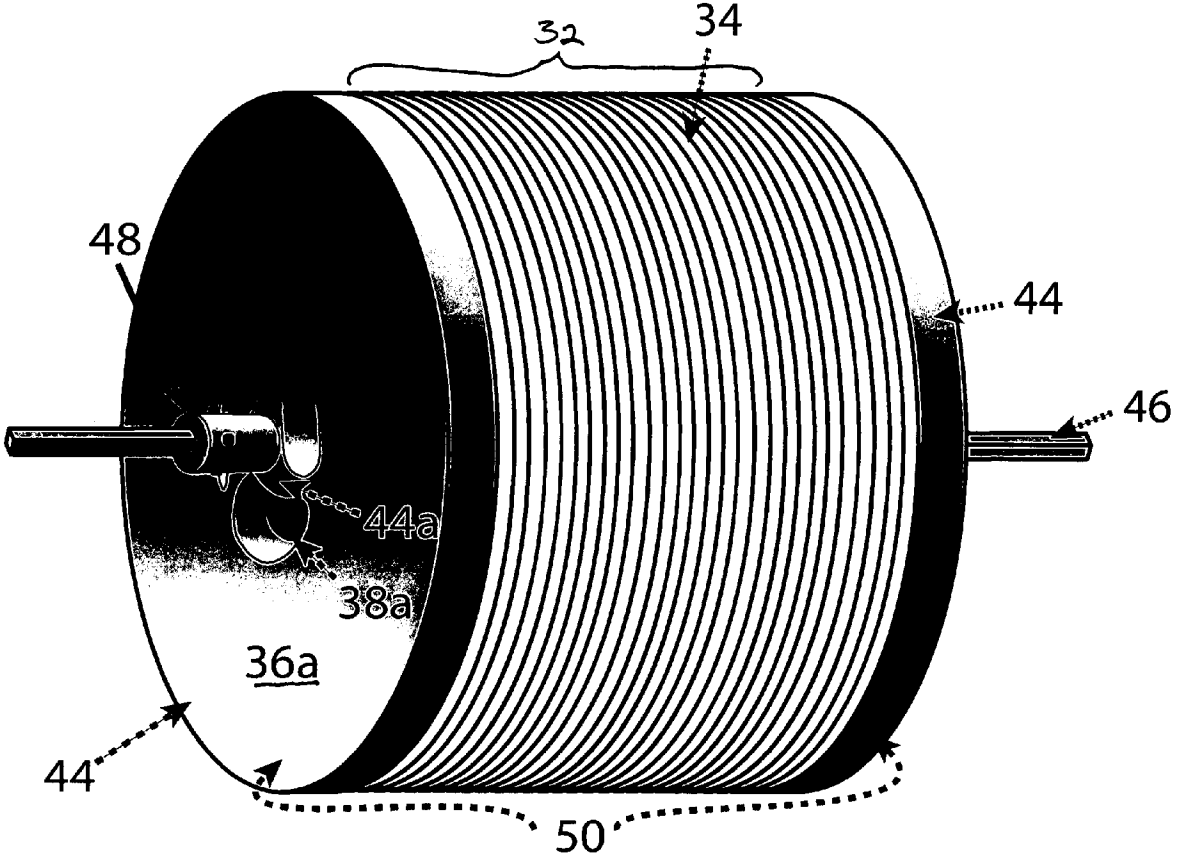
FIG. 6*a* illustrates Applicant's rotor assembly stack and stack assembly (rotors with endplates), as well as the manner in which endplates with retaining collars, including locking set screws and a non-round axle shaft may be used.
Figure 6B:
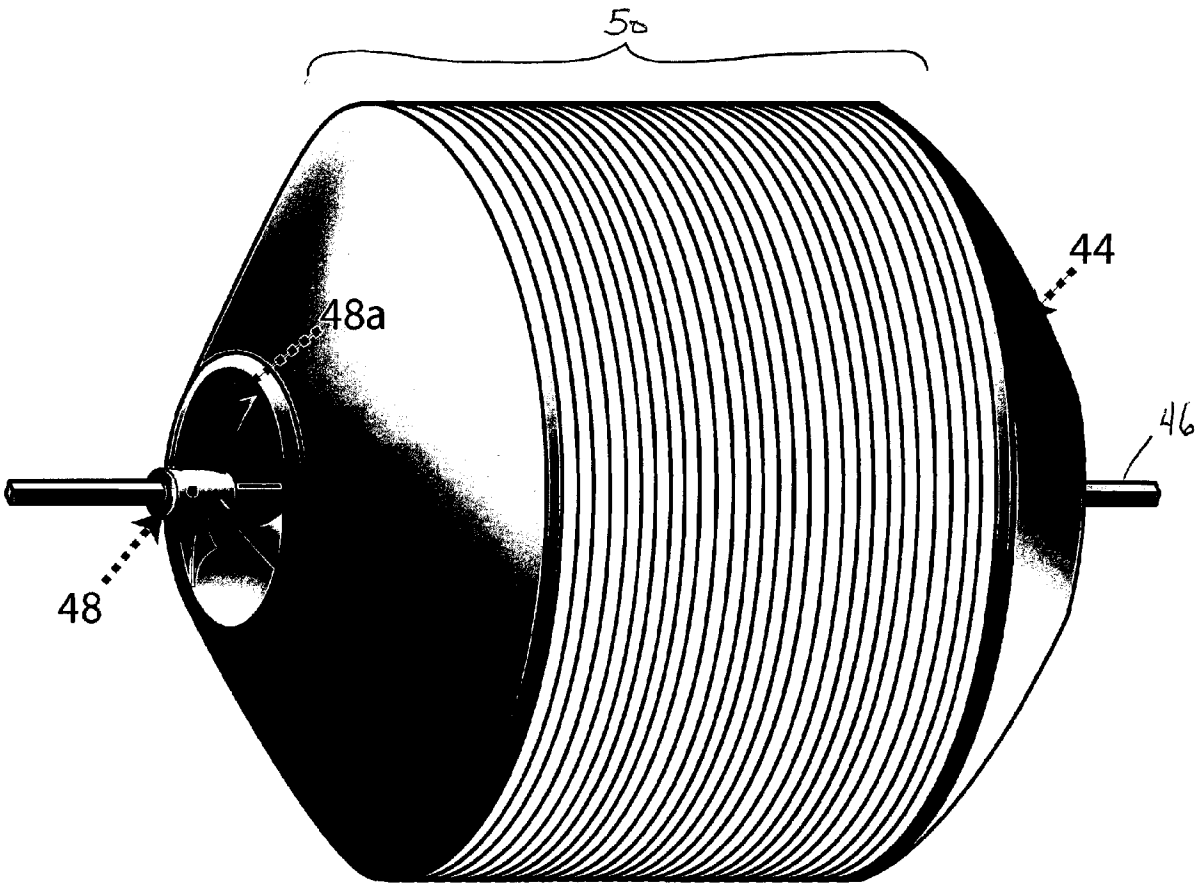
FIG. 6*b* illustrates Applicant's stack assembly, including a novel retention collar having fan-like struts connecting the collar to the endplate, the endplate illustrated being piano-conical shaped.
Figure 6C:
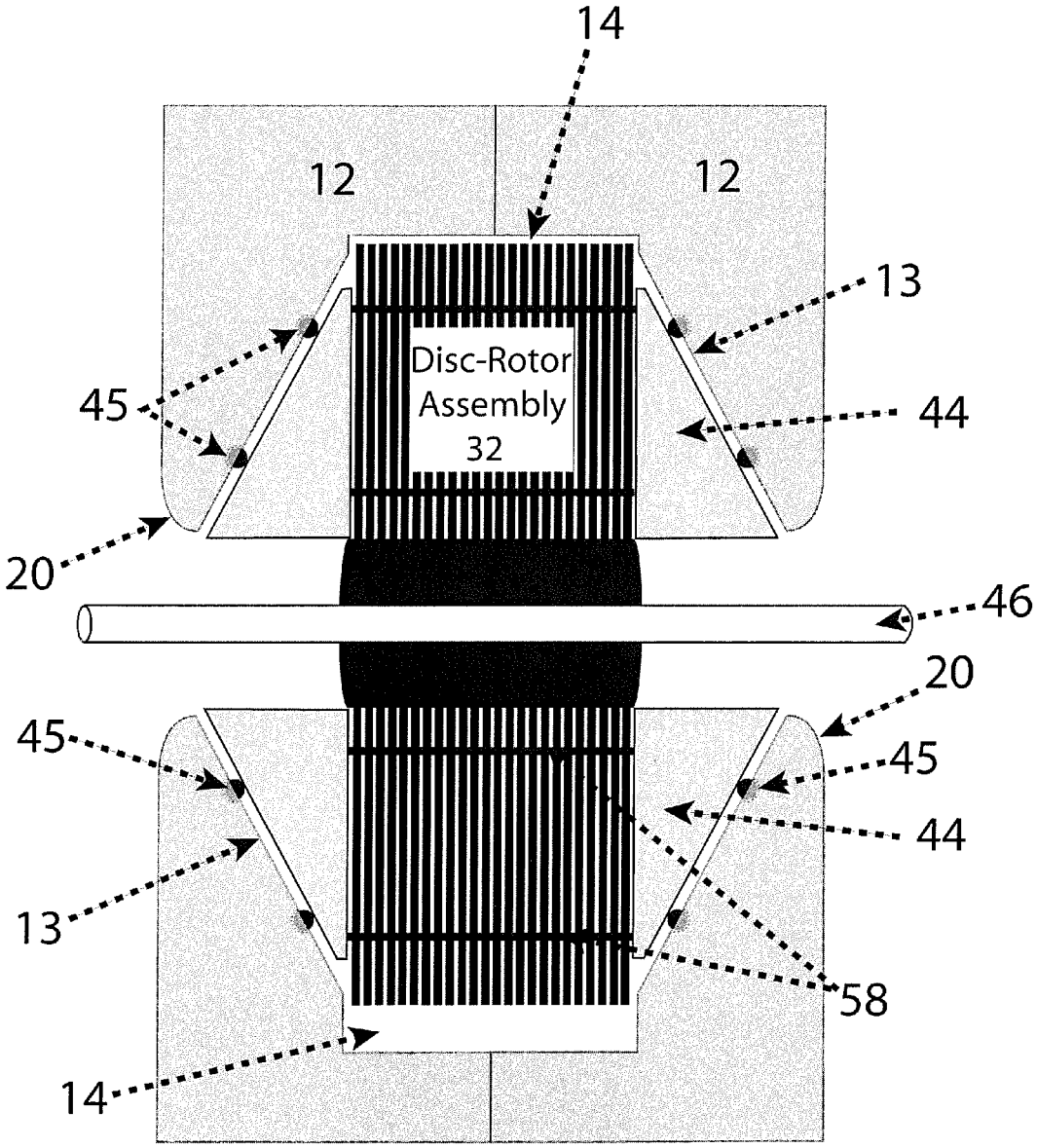
FIG. 6*c* is a cross-sectional view of the rotor assembly showing inner walls of the turbine rotor housing in the manner in which the conical endplates may engage bearing and glide surfaces.

It is seen in FIGS. 6*a*-6*c*, for example, that, optionally, a pair of endplates 44 may be provided at each of the removed ends of the rotor assembly 32, which endplates are typically, but not necessarily, thicker than the second thickness. These are designed to prevent warping of the rotors by applying a compressive force on the rotor assembly directed inward from the pair of endplates. The compressive force may be applied through retaining collar 48, which may be separate from or optionally be part of the endplate and affixed to axle 46 in ways known in the art (such as a set screw). Endplates 44 typically include spokes 44*a*, walls defining central openings 38*a*, runner portion 36*a*, and walls defining an axle opening 42*a*.

When rotors 34 are entrained on axle 46 with the endplates 44 on the outside under compression and retained with collars 48, the rotors 34 and endplates 44 define a stack assembly 50, the stack assembly typically held under compression. The stack assembly is maintained within rotor housing 12, such that the rotor housing substantially encloses the runner portion of the stack assembly 50. Thus, as the bladeless pump is driven in the direction illustrated in FIG. 3, adhesion between the fluid and the walls of the runner portion will provide the propelling force for molecules adhering to the runner portion to move outward under the impetus of the power of the motor 72 spinning the stack assembly 50.

Figure 4:
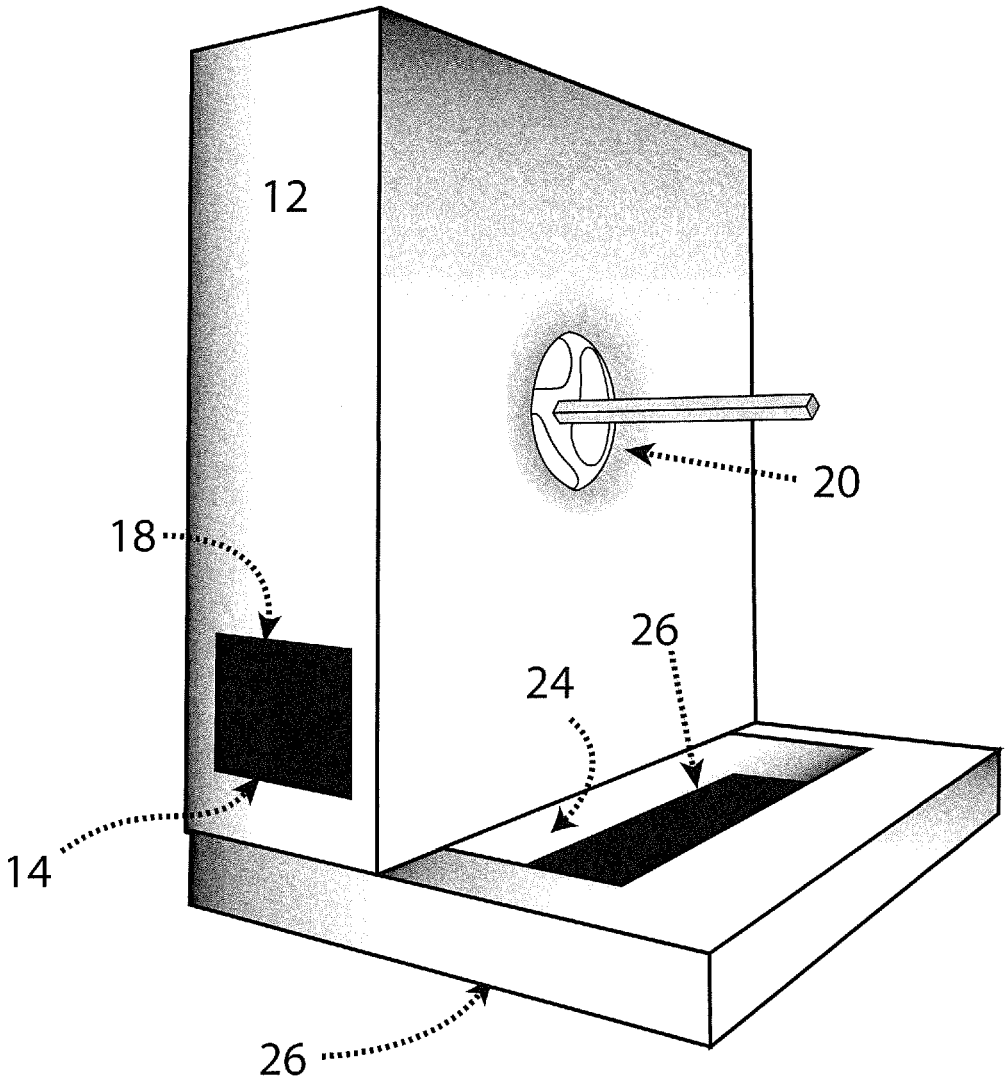
FIG. 4 is a perspective view of the rotor housing showing the air or fluid inlet on either side of the rotor housing and fluid outlet in the base of the rotor housing.

When endplates are not used, rotor assembly 32 have the rotors fused to or otherwise engage the axle and placed within the housing such that the central openings are adjacent the rotor feed opening as seen, for example, in FIG. 4, and as seen in the prior art FIG. 1B, to provide fluid communication to the central openings 38.

Figure 7:
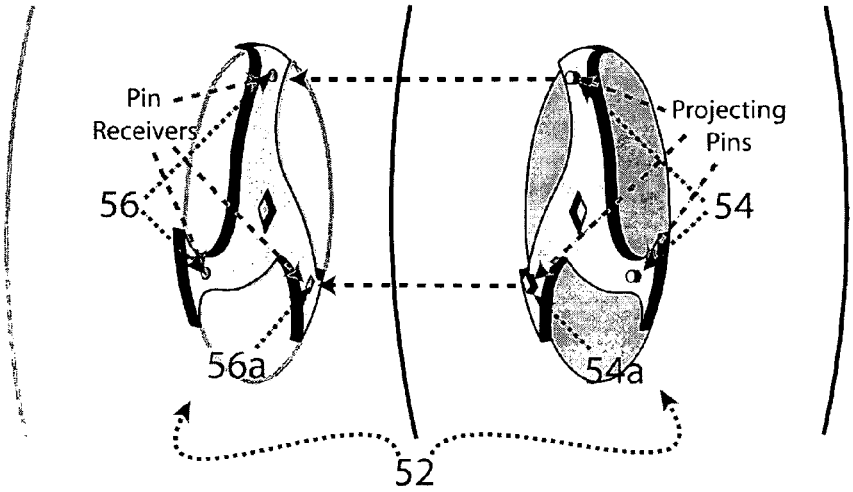
FIG. 7 illustrates the manner in which pin receivers and pin projections may be used to align and, in a locking manner, engage spacers or rotors without spacers.

Spokes 40 of rotor 34 may typically include a means to lock the spokes in alignment through the use of projection pins 54 mating with pin receiving indentations 56 as seen in FIG. 7. Pins 54 may have a first shape different (here, a circular shape) from pins 54*a* (for example, rectangular), which receiving indentations 56 and 56*a* would have shapes substantially matching their opposite pins. On the other hand, the pin shapes may be the same, but in different positions on the spokes. Either way, the proper fit of pins into indentations would ensure that the alignment of the spokes would be proper. This is important as Applicant provides, in one embodiment, for a non-round axle 46, such as an axle in a polygonal shape. In certain polygonal shapes, alignment is important as the axle will not slide all the way through the axle openings if one of the discs is not properly aligned. For example, if the axle had a rectangular cross-section, the spokes, being typically radially equidistance one from another, one of the discs could be turned with respect to the others and strike the axle preventing it from going through as it would with properly aligned axle openings.

Figure 8:
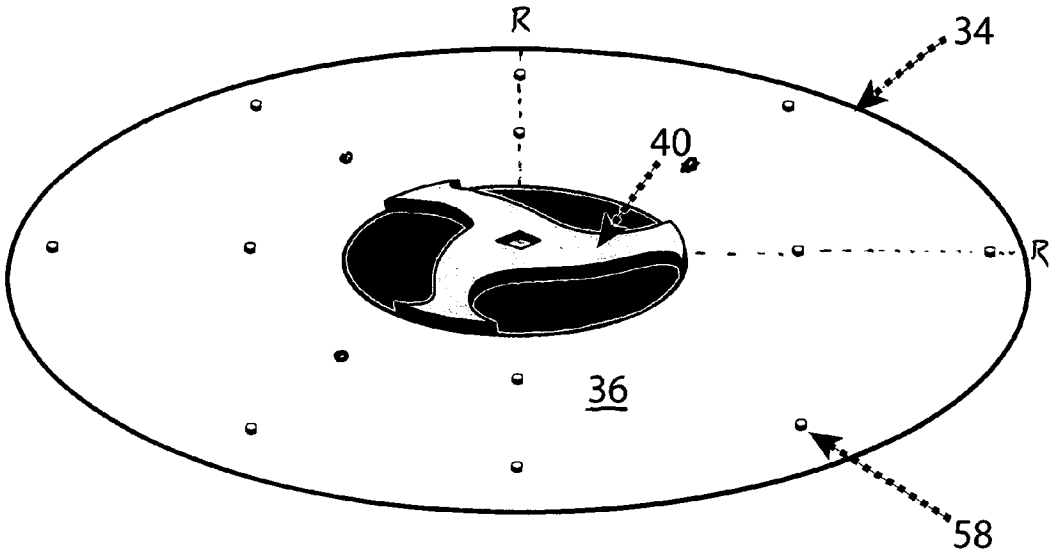
FIG. 8 is a perspective view of a rotor showing standoff projections, here two sets defining generally concentric circles and how the standoffs have a height that is equal to the thickness difference between the spokes and the runners.

One side of each of Applicant's rotors 34 typically includes multiple bosses or standoffs 58 typically integral with the runner portion, whose standoff thickness is approximately the difference between the first and second thicknesses. When the stack assembly is viewed with respect to the position of the standoffs 58 (see FIGS. 6*c* and 8), they may be seen to form one or more "circles" of standoffs at a radius from the axis of axle 46. Further, the standoffs may be positioned along a series of radial lines R as seen in FIG. 8, that is, lines drawn between the axle and the edges of the rotors. When viewed in cross-section in FIG. 6*c*, the standoffs may define two or more concentric circles. The function of the standoffs includes helping prevent the discs from flexing especially near the outer edges and helping straighten or flatten discs that may be warped in the manufacturing process. One or both of the endplates may have a set of standoffs.

Figure 9:
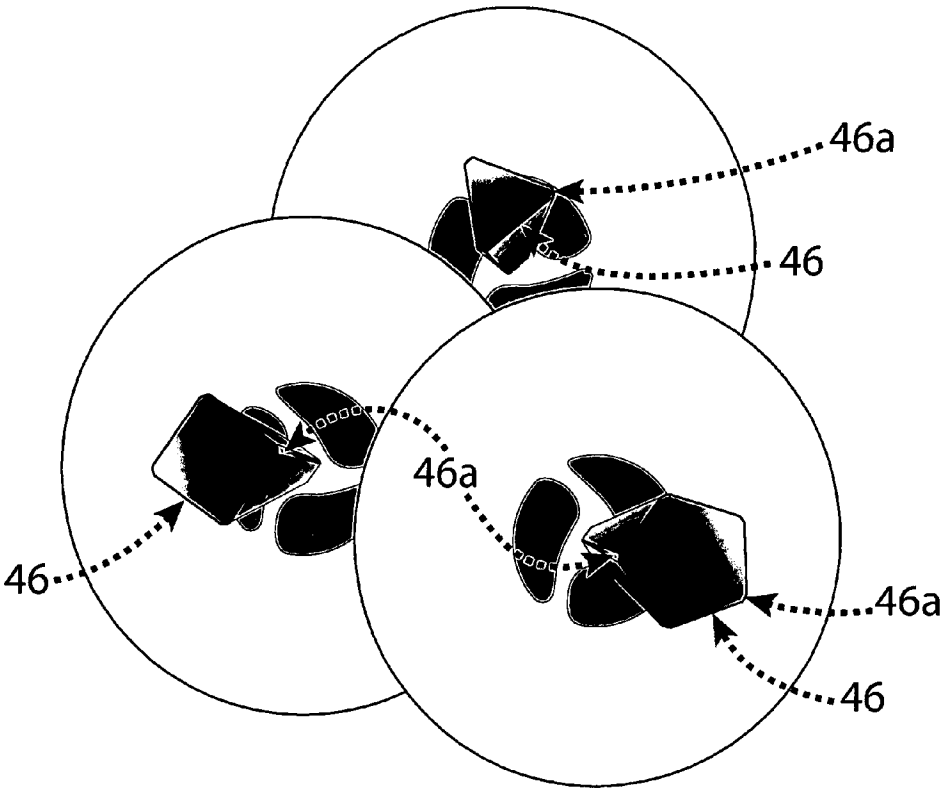
FIG. 9 illustrates in perspective view the use of non-round axles, including a square axle, a triangular axle, and a pentagonal axle, with their corners radiused.
Figure 10A:
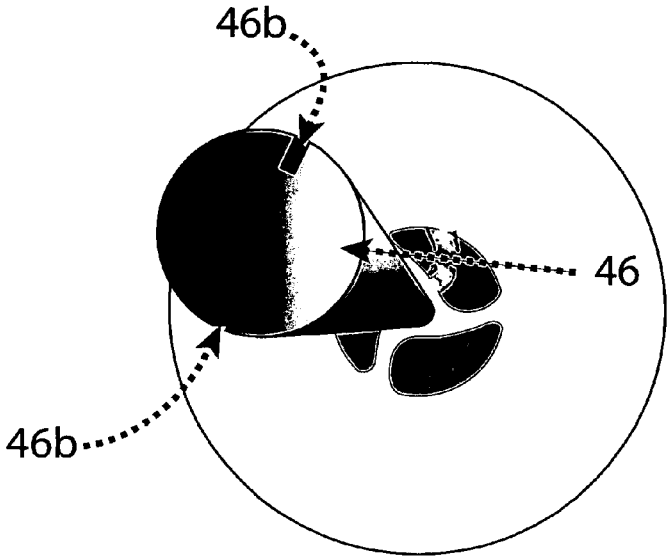
FIG. 10*a* illustrates the use of round shaft with dual keyways for engaging the shaft to the rotors and the endplates.
Figure 10B:
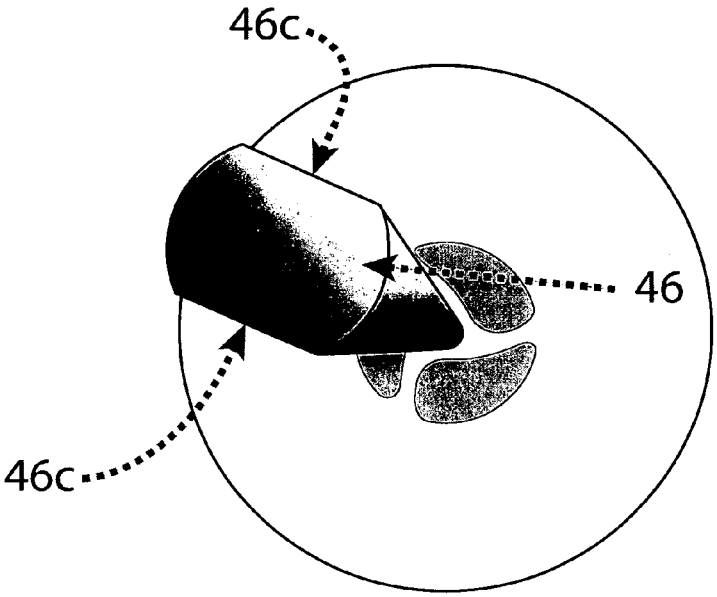
FIG. 10*b* illustrates a dual broached round shaft for engaging rotors.

In one embodiment, as set forth above and in FIG. 9, axle 46 has a polygonal shape. Moreover, the corners of the polygonal shape may be faceted or broached 46*a* (see FIG. 9). This broaching will help avoid otherwise sharp edges between sides of a polygon and will help avoid fracturing or the concentration of forces at the otherwise sharp edges. The axle openings 42 in the rotors and endplates are shaped to fit snugly with axle 46. If axle 46 is round in one embodiment, all of the spoke sections 41 define at least one keyway along with a 46*b* keyway in the axle 46, and a key for engagement of the axle to the keyway in the spoke (see FIG. 10*a*). FIG. 10*b* shows a "dual broached" round axle 46*c*. In the case of stamped metal discs, these may be fused to a completely round shaft by a glue or welding process.

Turning to FIGS. 6*a* and 6*b*, it is seen that endplates 44 may be dimensioned similarly to the rotors only thicker to help transmit the compressive forces to the multiplicity of rotors 34 contained there between or, set forth in FIG. 6*b*, or they may be planar conical shaped, thicker at the center and thinner near the edges. Moreover FIG. 6*a* illustrates the manner in which the endplates may engage the end rotors, so as the walls defining central opening 38*a* of endplates match up with the walls defining central openings of the rotors, and the endplate spokes 44*a* match up with the spokes 40 of the rotors 34. FIG. 6*b* also illustrates how a retaining collar 48 may include fanlike struts 48*a* connecting the collar to the endplate, so as to help accelerate air into the central openings 38 and 38*a*.

FIG. 6*c* also illustrates a manner in which compressive forces assist alignment and rigidity of the rotor assembly. Namely, Applicant's in one embodiment may provide bearing or glide surfaces 45 between the outer surfaces of the endplates and the inner walls of the rotor housing 12. Bearings, such as ball bearings, or glide surfaces 45 are also used to maintain proper alignment of axle 46 and stack assembly 50 (or rotor assembly 32 if no endplates are used) with rotor housing 12 preventing lateral motion of the assembly along the axle.

Individual rotors 34 and endplates 44 may be made of plastic composites or a ceramic material and may be made by machining, by the process of injection molding, metal stamping, or any other suitable process. Indeed, the rotor housing, base, and cover may be injection molded ceramic or plastic.

Each rotor 34 comprises a runner portion 36 and a spoke section 41 and may be manufactured as a single integral unit, again with the thickness of the spokes greater than the thickness of the runner portion. A second method of manufacturing (see FIG. 5*a*) would be a multiplicity of rotors having a single uniform thickness of T1 comprising both the runner portion 36 and the spoke portion 41 with the addition of separate spacers 47 to separate one rotor from the adjacent other. For example, illustrated in FIG. 5*a* is the use of runners and spacers which may be die cut from very thin materials, such as metal shim stock or extremely thin rigid plastic, such that the central openings will match up the runners and the spacers and the shaft. The separate rotors and spacers may be cut from different thicknesses and different materials. Thinner runners will reduce weight and improve rpm of the unit. Higher rpm tends to improve pressure and flow. Decrease in the thickness of the spacers may also improve pressure and increase the number of runners per inch of rotor stack. Thus, one die can cut out any thickness of runner and spacer, allowing much more variability in the flow and pressure a single turbine design can deliver.

The assembled stack of rotors and spacers (FIG. 5*a*) or the integral units may be clamped together on a shaft and a wicking glue or other adhesive may be applied to permanently fix the runners to the spacers (or the rotors to one another if no spacers are used) and both to the shaft. Doing so, one may avoid the need for retaining collars 48, such as those illustrated in FIG. 6*a*. Gluing the axle runners and spacers together may also eliminate the need for endplates. The use of a single die to generate any number of different thicknesses of runners and spacers means fewer injection molds will be needed and additional expense may thus be avoided. That is to say, runners and spacers may be die cut from very thin material, such as metal shim stock or extremely rigid plastic, such that the axle holes will match up a runner and a spacer. That is to say, the rotors may have a runner portion and a spoke portion that has the same thickness, but use spacers 47 between adjacent runners and/or at the end of a rotor assembly, with or without endplates. Spacers may be cut from different thicknesses and materials. Decreasing thickness of the spacers improves pressure and increases the number of runners per inch of the rotor stack. Gluing together or otherwise affixing a number of rotors together and to the axle avoids the need for retaining collars to hold the stack to the shaft and the runners and spacers to each other.

Figure 11D:
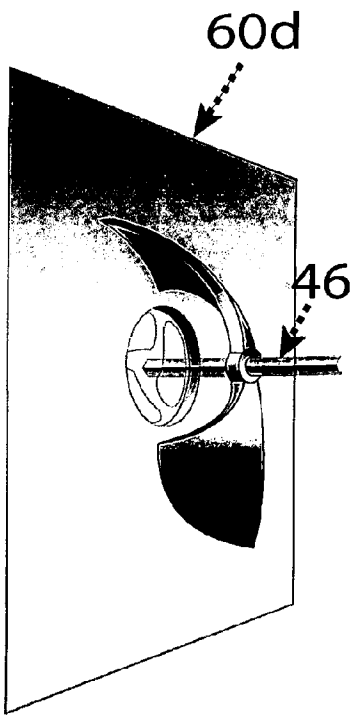
FIGS. 11*a*, 11*b*, 11*c*, and 11*d* illustrate four bearing variations used to affix the shaft to the motor housing and/or bearing standards, including planar, straight, vane and vortex vane bearings.
Figure 11C:
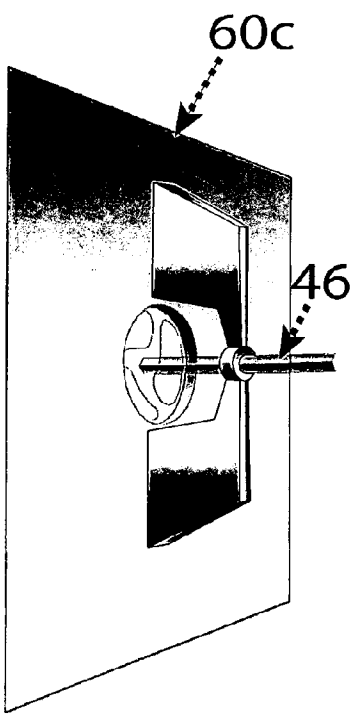
Figure 11B:
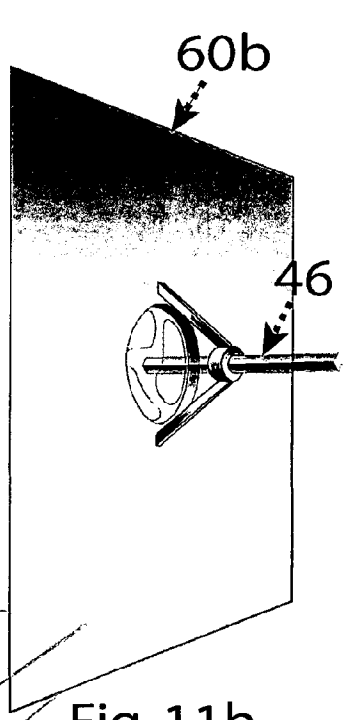
Figure 11A:
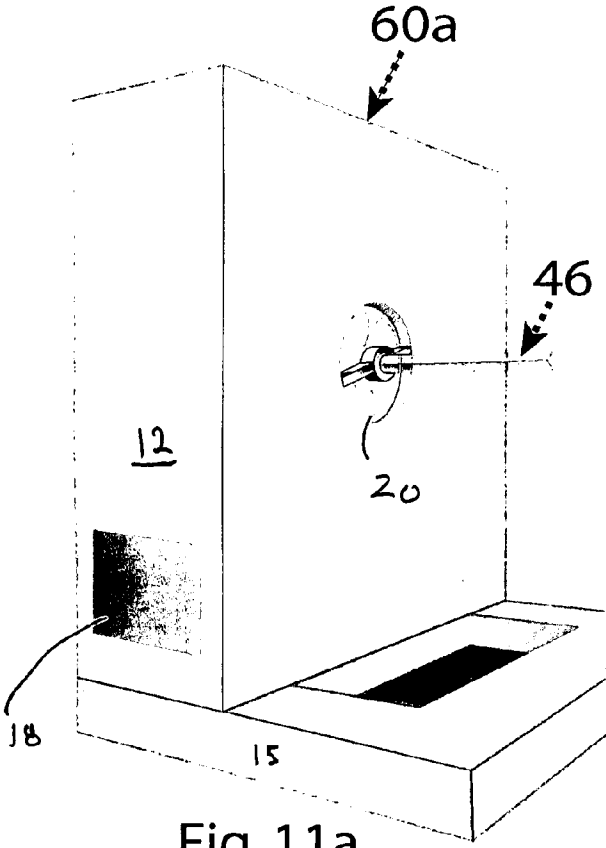

FIGS. 11*a*-11*d* illustrate a number of bearing configurations 60*a*-60*d*, for use in any embodiment, for rigidly mounting axle and/or its bearing 46 to rotor housing 12 which itself may engage to a base 15. FIG. 11*a* illustrates a planar bearing assembly 60*a* that spans the rotor feed opening 20 and is in the plane thereof. FIG. 11*b* illustrates a strut braced bearing assembly 60*b*. FIG. 11*c* illustrates a straight vane bearing assembly 60*c*. FIG. 11*d* illustrates a vortex vane bearing 60*d*, which provides some rotation to the air entering rotor feed opening 20.

Figures 12A, 12B:
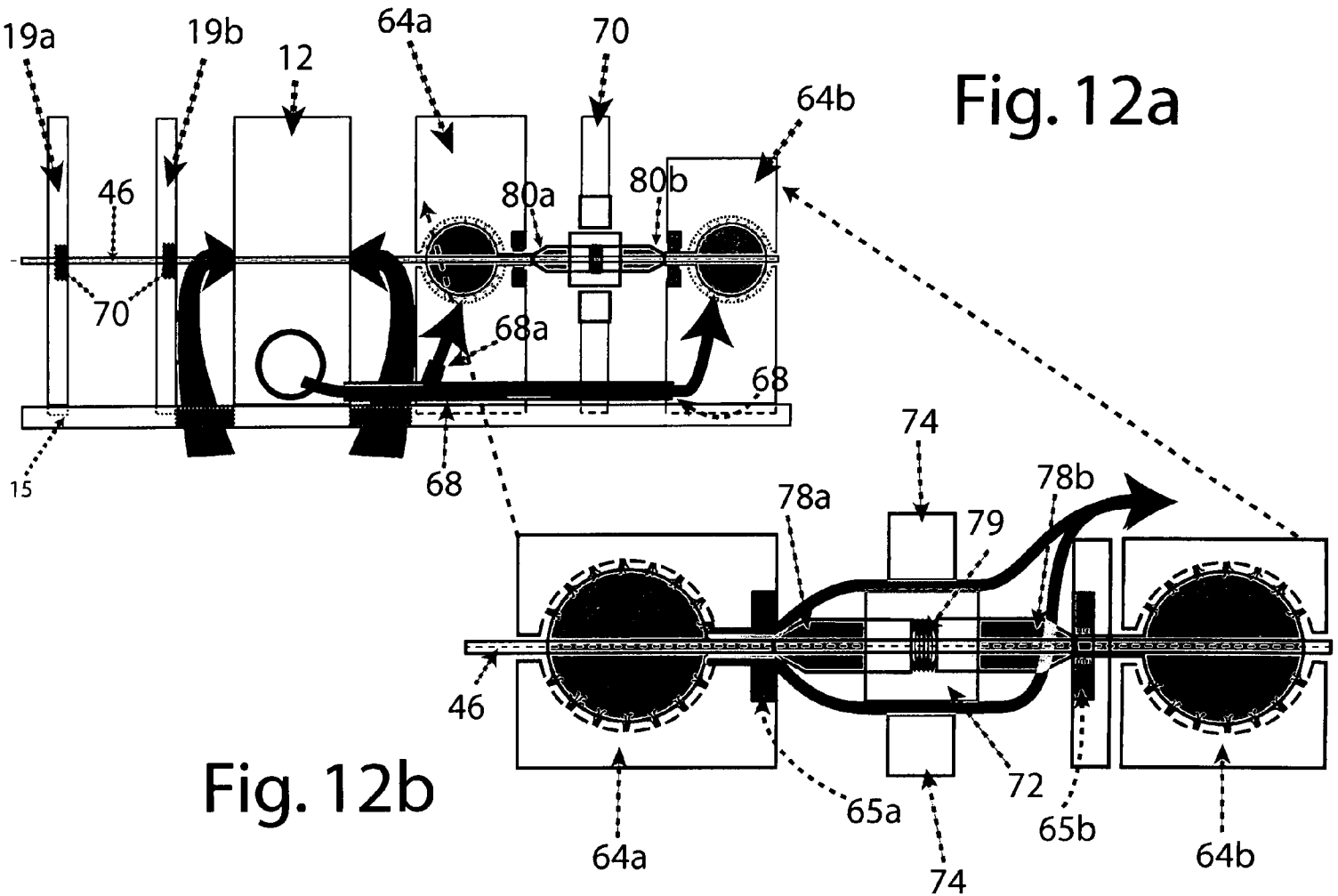
FIGS. 12*a* and 12*b* illustrate in cross-section the manner in which air bearings may be used in conjunction with transition bearings to maintain the axle in proper alignment.

In an alternative preferred embodiment (see FIGS. 12*a* and 12*b*), the bearings means may include, instead of bearings rigidly aligning the axle 46 with the rotor housing 12, an air bearing assembly including multiple bearings and a set of transition bearings 65*a* and 65. The transition bearings (which may be tapered bearings) will maintain the axle 46 in a fixed position during run-up and run-down of motor 72 and during an off position. Reference is made to FIGS. 12*a* and 12*b* that illustrate a set of air bearings 64*a* and 64*b*, along with transition bearings 65*a* and 65*b*, which operate in conjunction with a novel two-piece motor rotor 78*a* and 78*b*, the two piece rotor separated by a coil spring 79. Motor standards 70 maintain motor stators 74 in a rigid position. When motor 72 rotor is at rest, conical surfaces 80*a* and 80*b* of motor rotors 78*a* and 78*b* are, under urging of spring 79, pressed into transition bearings 65*a* and 65*b*. However, as the motor starts during run-up, pressurization at the air bearings through the multiple air pressure jets illustrated and through air flowing between the transition bearing and conical surfaces 80*a* and 80*b* will ease the compression of coil spring 79 and move the motor rotors 78*a* and 78*b* off the transition bearings so there is no surface-to-surface contact when the motor is at speed. Air bearings and transition bearings are known in the art.

Figure 13:
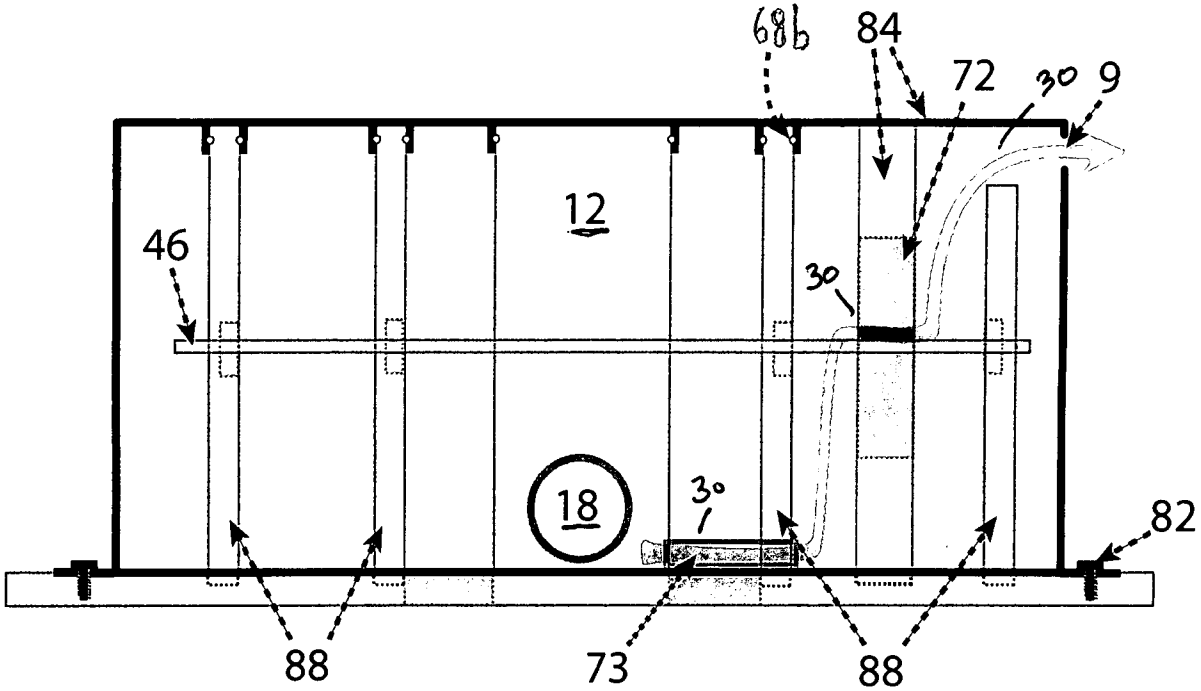
FIG. 13 illustrates in cross-sectional elevational view the manner in which the cover and base engage the bearing standards, turbine rotor housing, and the motor standards to hermetically seal them to the cover and thereby reinforce them and dampen vibration while the turbine is running.
Figure 14:
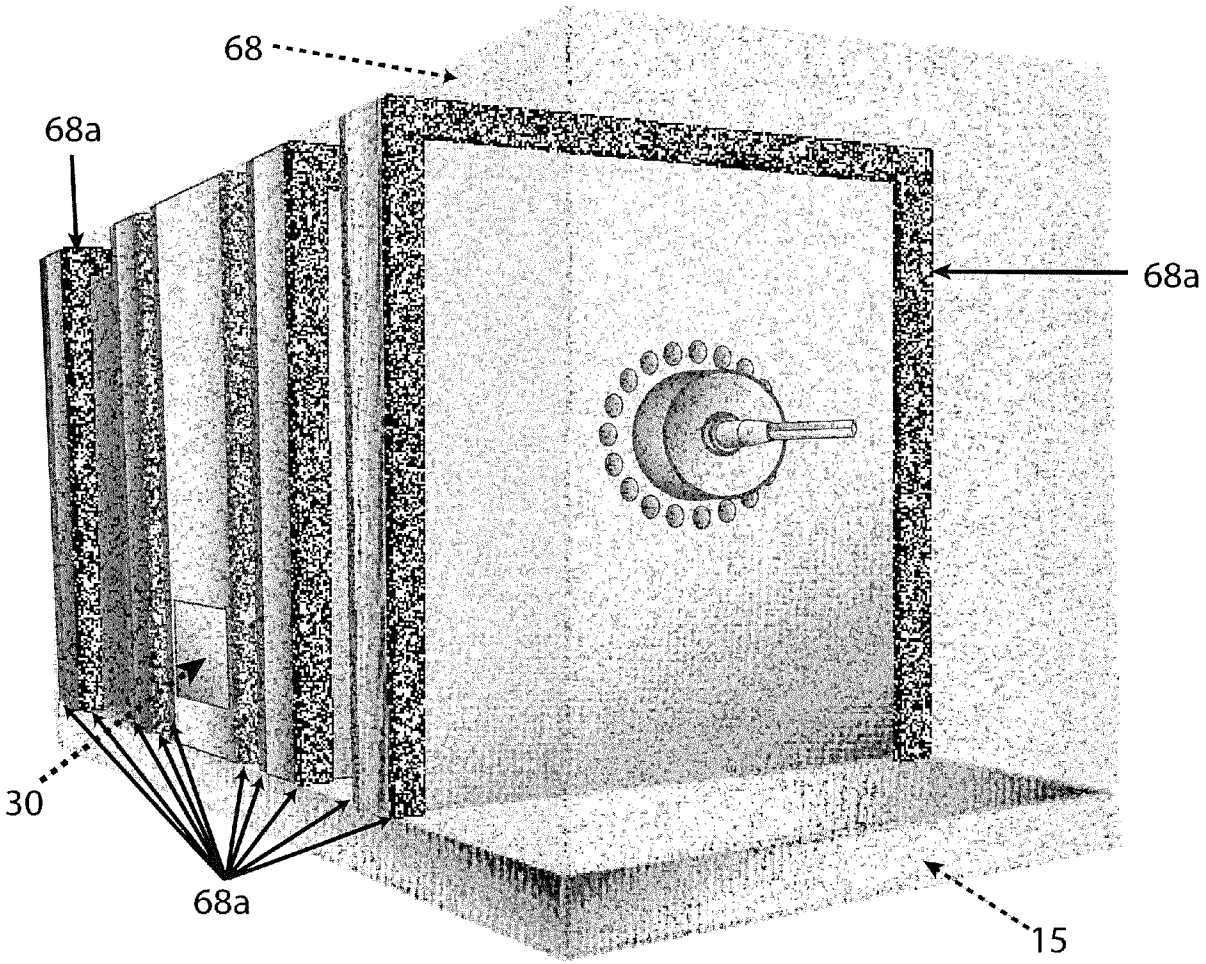
FIG. 14 illustrates an elevational cutaway view of the manner in which the cover may be sealed to elements, including bearing and motor standards, rotor housing, and the base through the use of internal cover ridges.
Figure 15:
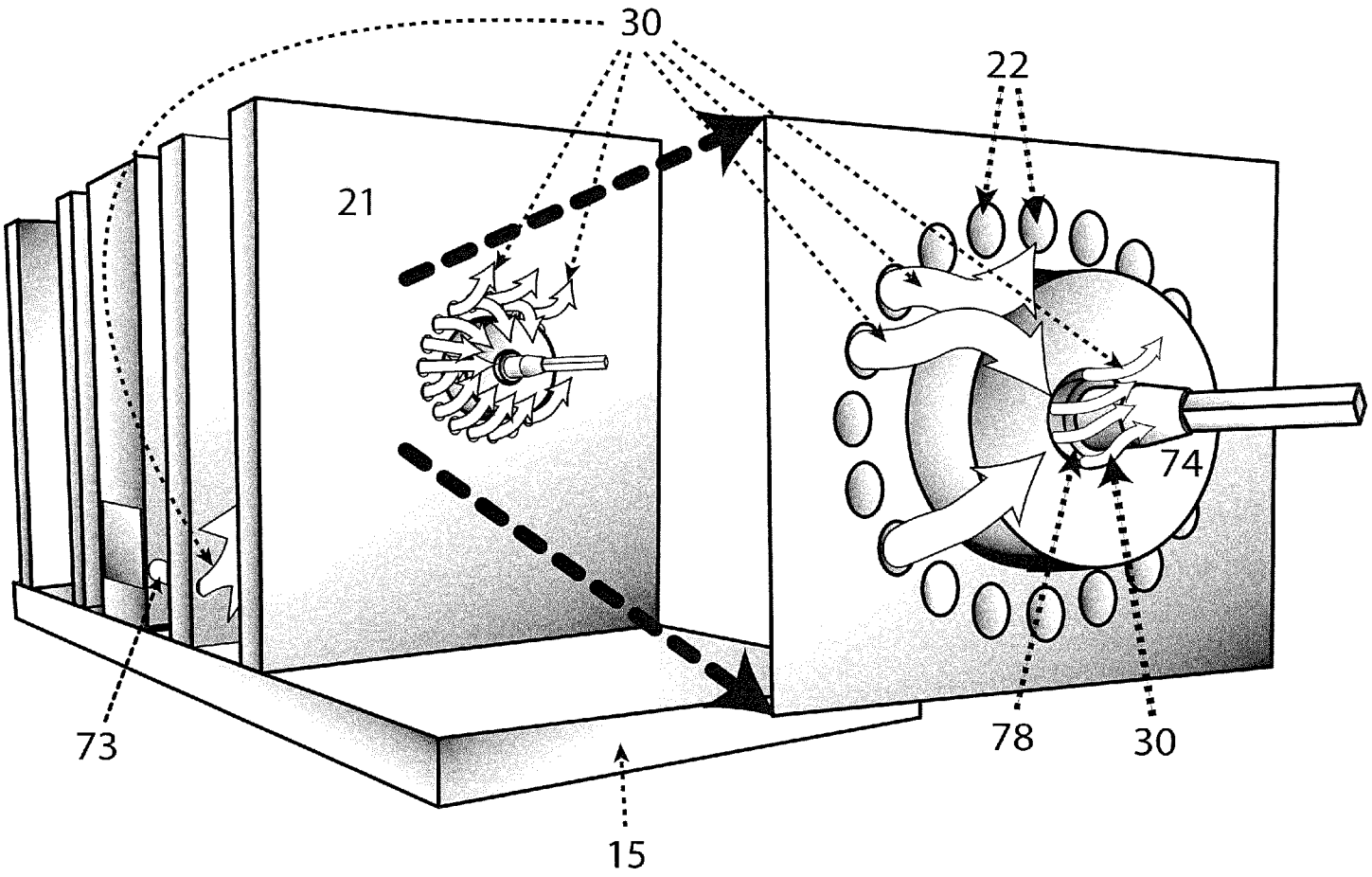
FIG. 15 illustrates an exploded perspective view of the manner in which air flow may be directed from the turbine rotor, under pressure, to the motor to help cool the motor.

Turning now to FIGS. 2*a*, 2*b*, 13, 14, and 15, it is seen that a base 15 may be provided, the base engaging a motor housing 21, the rotor housing 12, one or more bearing standards 19*a*-19*d*, and a cover 68 for sealing to the base 15 so that the base/cover combination provides an air inlet 26 for providing air to the stack assembly or rotor and the spiral volute outlet. Note the use of the base/cover combination may allow for omitting passageway walls 28 and may comprise a portion of the rotor and motor housings. In addition, the porting or venting assembly 30 may be provided for transferring air under pressure from the volute to the motor housing 21 to cool the motor therein and then to expel such warmer air from a port 90 on the cover 68 which port 90 is located away or removed from the air inlet 26. The use of the cover 68 and base 15 assembly to define the location of the intake of the air to the rotor assembly and to use some of the pressurized air or other fluid to cool the motor, and then to expel the coolant fluid away from the air inlet will help isolate the heat developed by the motor 72 from the fluid drawn in and pressurized by the bladeless pump 10. If air bearing 62*a* and 62*b* are used, venting assembly 30 may be used as illustrated in FIGS. 12*a* and 12*b* to support the air bearings and compress coil spring 79. The use of cover 68, along with cover ridges 68*a* and elastomeric seal 68*b* combined spaced apart sufficiently to enclose the tops of the standards, housings or walls as seen in FIGS. 2*b*, 13, and 14, will help pneumatically seal and support the rotor and motor and the rest of the assembly. Elastomeric seals 68*b* will help firmly isolate (sound, heat, air, vibration) the motor from the pump so as to avoid air from the motor raising the temperature of air at the outlet opening. Insulation (spun fiberglass, foam, etc.) between the motor and rotor housing may also be used. The cover/base combination and the venting assembly is especially desirable when one of the objectives is to provide pressurized cool air at the volute fluid outlet 18. Note that the cover may have inner walls that fit snugly against the walls of the standards and motor and/or rotor housing. Cover 68 may have a fluid outlet opening matching and adjacent the fluid outlet opening of the rotor housing.

Figure 17:
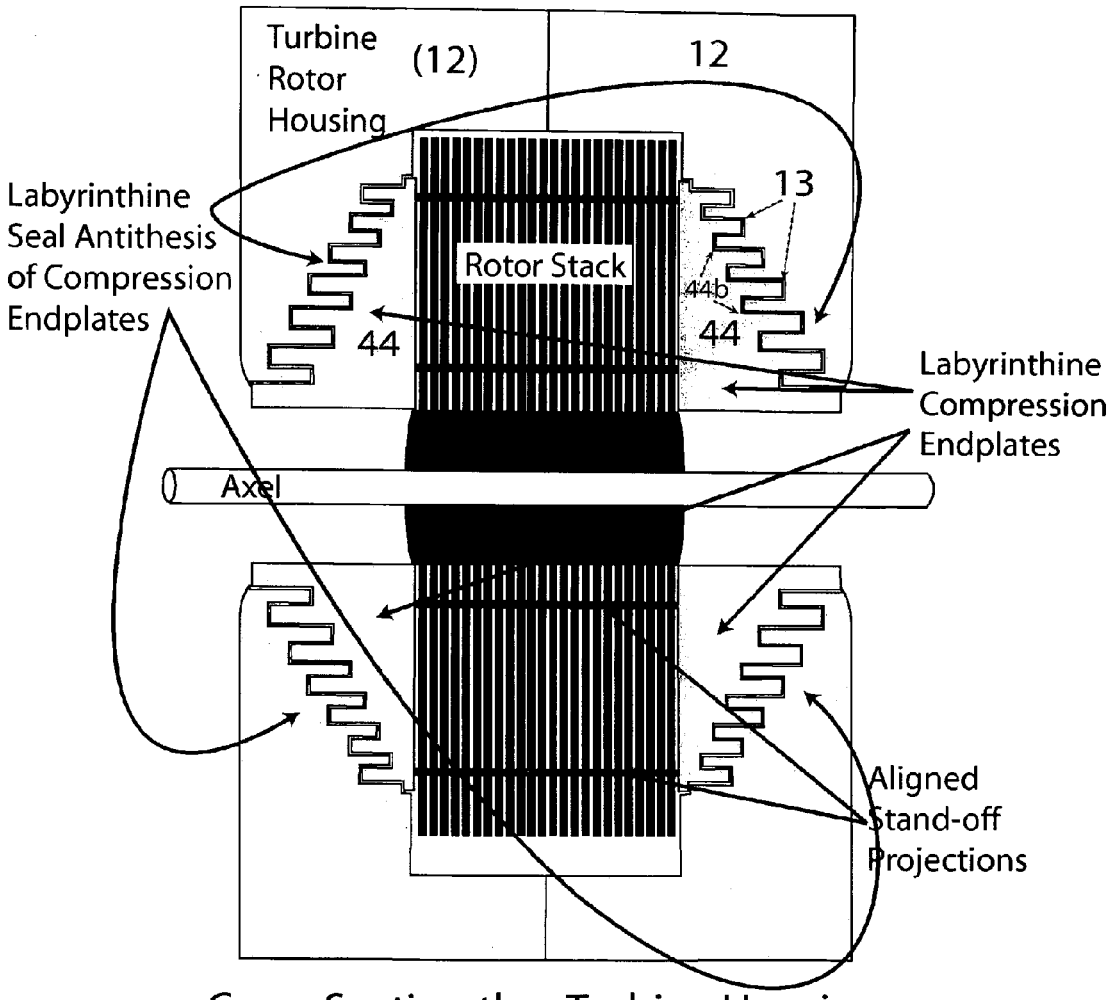
FIG. 17 is a cross-sectional cutaway view of the turbine rotor housing showing a tight but noncontacting labyrinthine seal between the endplates and the inner walls of the rotor turbine housing and also the manner in which the aligned standoff projections help space apart the individual rotors of the rotor stack.

FIG. 17 illustrates the manner in which rotor housing 12 may include inner walls which are labyrinthine in construction matching a pattern for endplate outer walls 44*b*, so as to help restrict leakage from the pressurized volute chamber through the gap between the endplate outer walls 44*b* and inner walls of the rotor housing 12.

Figure 18:
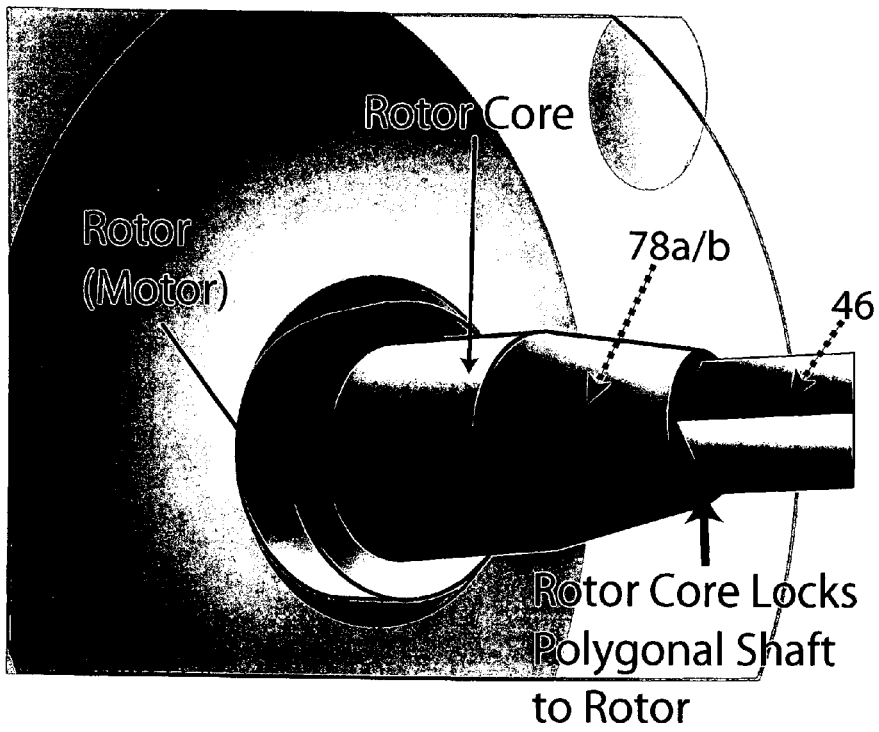
FIG. 18 illustrates the manner in which the rotor core locks against a polygonal shaft or axle to the rotor of the motor.

FIG. 18 illustrates the manner in which polygonal axle 46 locks into an appropriate dimensioned shaft in the motor rotor core 78*a*/*b* of motor 72, so that rotation of the rotor core imparts rotation to the axle and thus to rotor assembly 32.

FIGS. 2*a* and 2*b* also illustrate the manner in which one or more axle standards, here 19*a*, 19*b*, 19*c*, and 19*d*, are provided sealed to base 15, which axle standards hold the bearings to maintain the axle properly aligned to rotor housing 12, including a motor housing 21 for housing a motor 72 therein. It is seen how air from the pressurized volute 14 may be transferred to the motor housing 21 and passed into housing through vents 22 (on both housing walls). More specifically, coolant transfer tube 73 of venting assembly 30 may transfer pressurized fluid, such as pressurized air, from the volute to the motor in any manner, here through coolant tube 73 in motor housing 21. However, in alternate embodiments, one or more tubes may be provided with outlets adjacent the motor rotor to help dissipate heat therefrom. Moreover, it is seen that air provided to the motor housing can pass out the port 90 as illustrated in FIG. 2B. Thus pressurized air is transferred from a pressurized volute to the motor and then out housing to be expelled therefrom in an area away from the air inlets in an effort to keep such heated air away from the air intakes of the pump.

Figure 16:
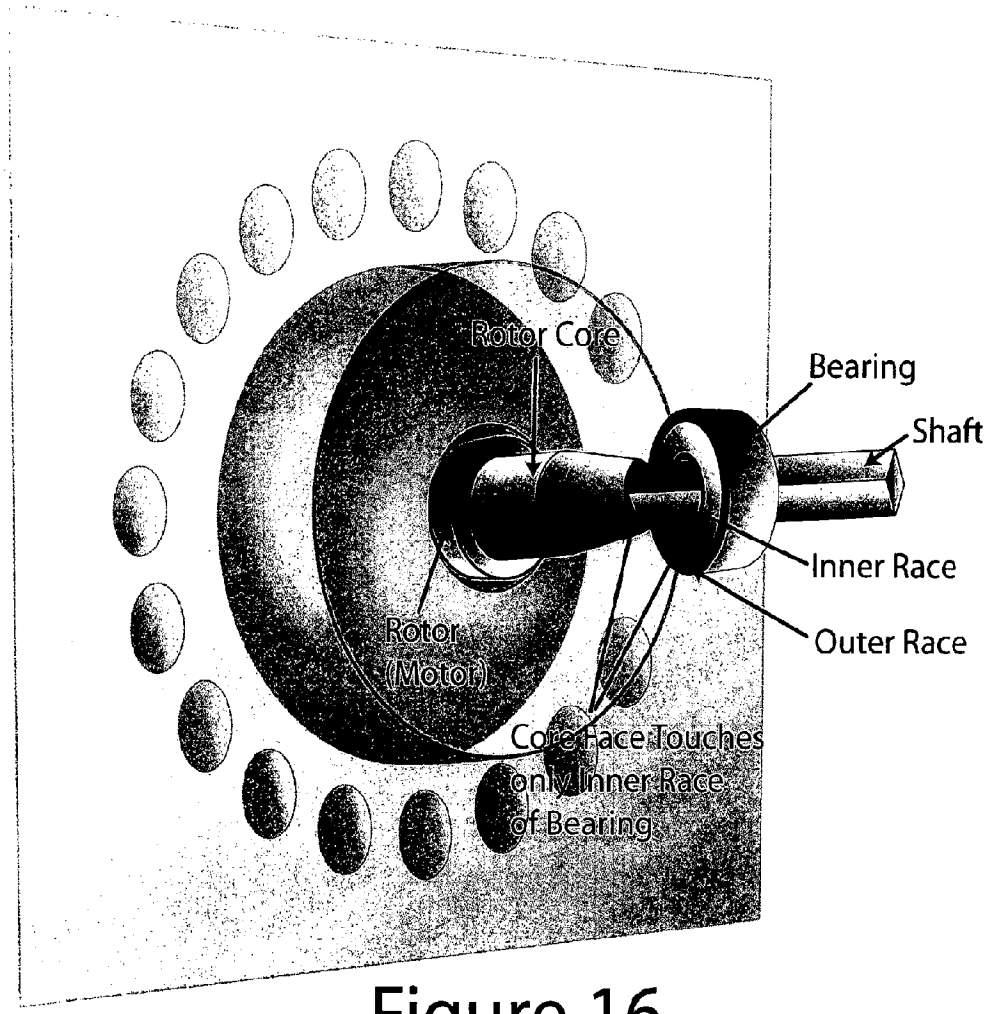
FIG. 16 illustrates in perspective view the relationship between the motor rotor, rotor core, bearing, and shaft, illustrating how the motor's rotor core contacts only the inner race of the bearing.
Figure 20:
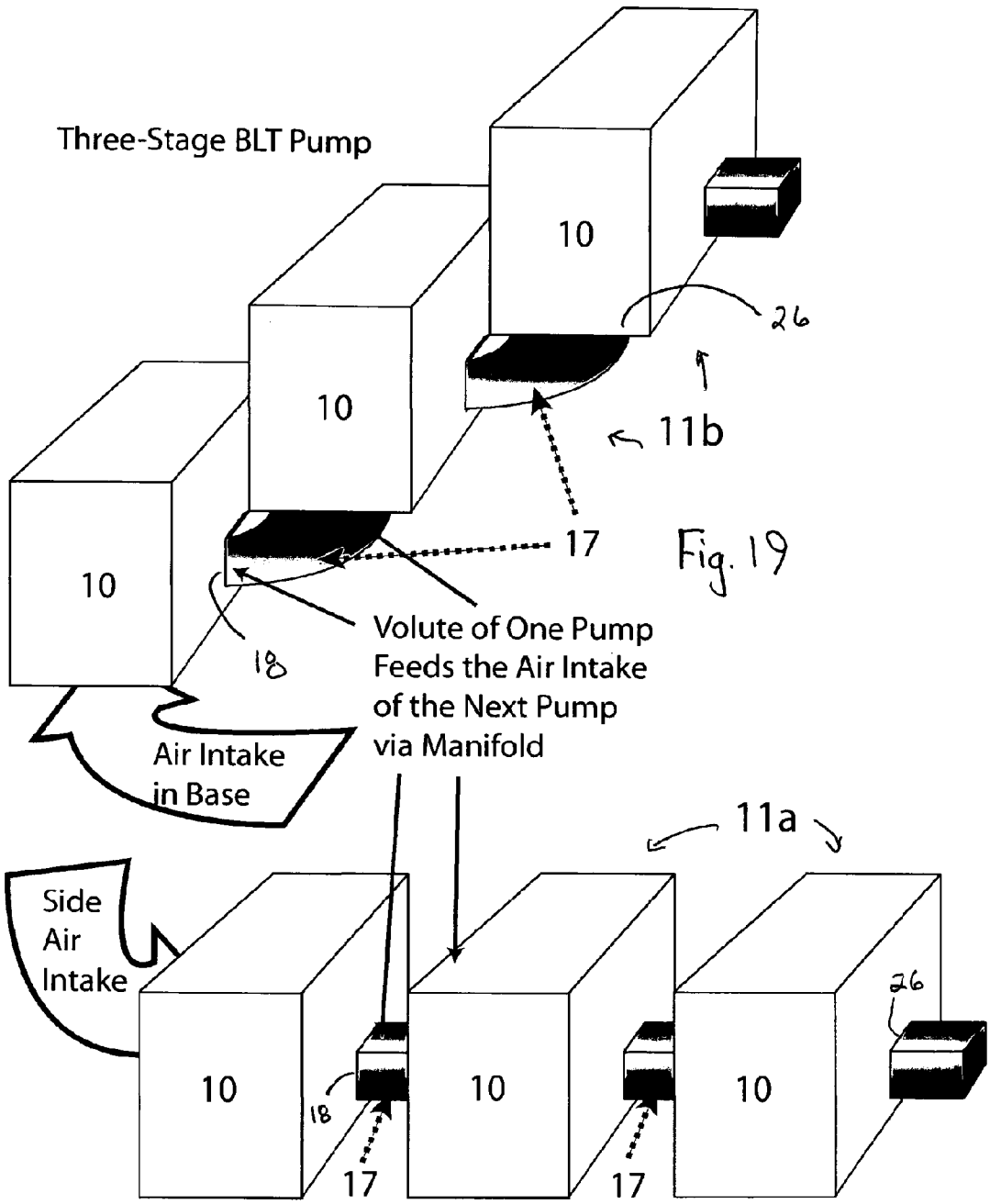
FIG. 20 illustrates a variation of the multi-stage pump.

FIGS. 19 and 20 illustrate two multi-stage pump assemblies 11*a* and 11*b*. In a multi-stage pump assembly, multi-stage connector members 17 connect up two or more bladeless pumps 10, such that the volute fluid outlet 18 of an upstream pump feeds fluid inlets 26 of a downstream pump. Whereas air at ambient pressure may be present at fluid inlet 26 for the upstream most pump of the multi-stage pump assemblies 11*a* and 11*b*, downstream pumps will have pressurized air presented to their respective fluid inlets 26. Three stage bladeless pump assemblies are illustrated, 11*a* placing the three pumps side-by-side (FIG. 20) and 11*b* placing the three pumps one above the other (FIG. 16).

FIGS. 21 and 21*a* illustrate rotor assembly 32, wherein the profiles of each rotor 34 differ from those set forth in earlier embodiments. The earlier embodiments disclosed a runner portion having a uniform thickness T1 (that is, the same thickness all along the runner portion). In FIG. 21, the runner portion progressively thickens to its outer edge such that openings between adjacent rotors become more restricted. This forces some compression of the spiraling outflow of the fluid as it leaves the outer edges of the rotors creating a higher pressure differential as compared to the earlier embodiments.

Figure 22:
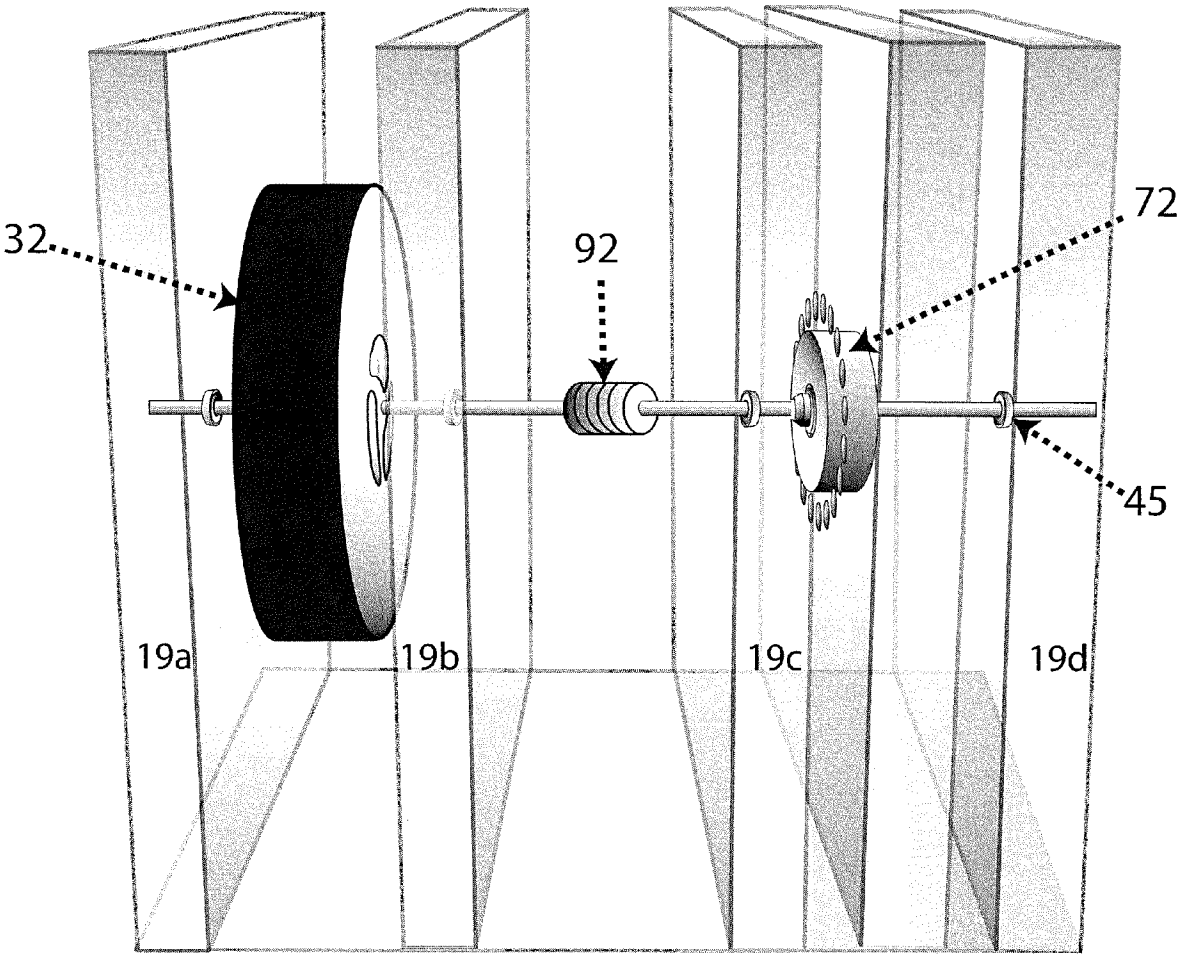
FIG. 22 is a perspective view of the device illustrating a rotor assembly positioned between adjacent bearing standards and the use of a dampening shaft coupler.

FIG. 22 illustrates a simplified version showing a disc rotor assembly, several standards, the motor, and the axle. More specifically, FIG. 22 illustrates a four bearing version having bearings, such as ball bearings rotating in bearing standards or roller bearings 2 to engage the housing and the axle, with a dynamic shaft coupler 92 to help dampen the vibration in the axle.

Figure 23:
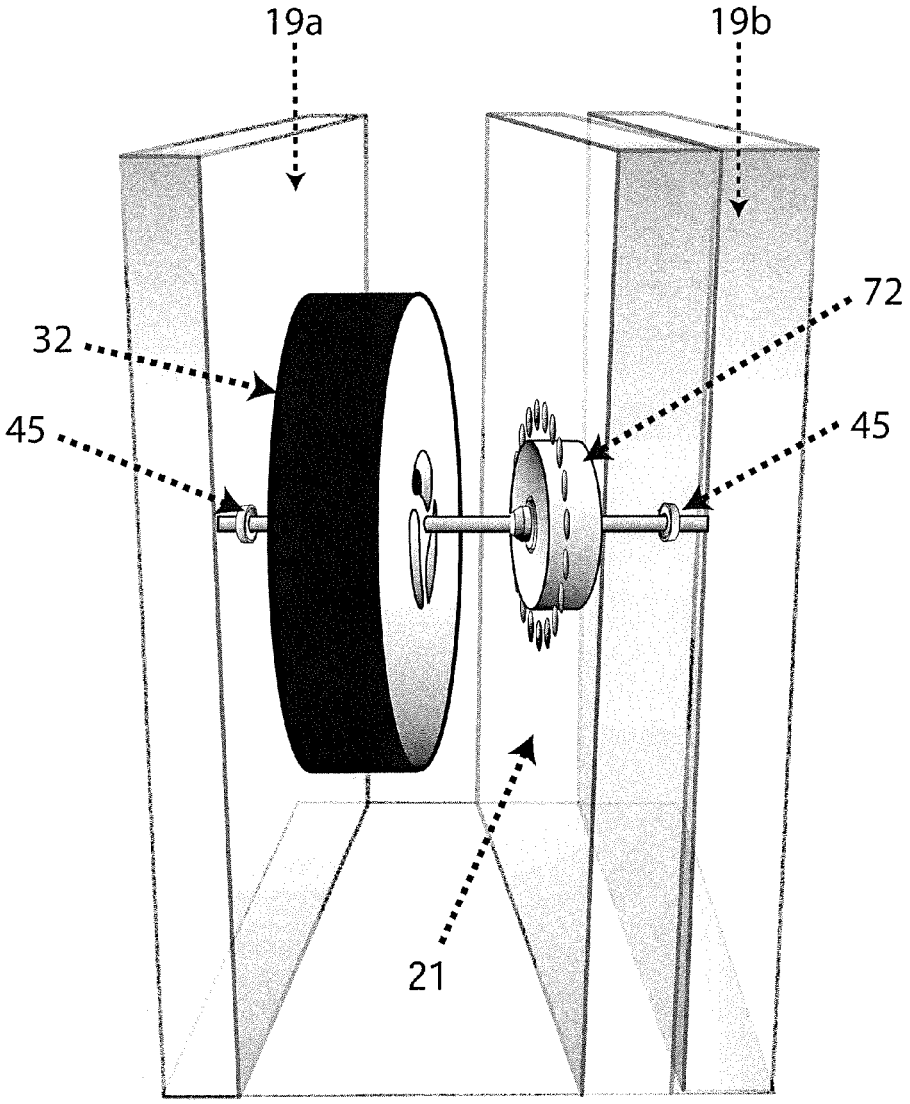
FIG. 23 is a perspective view illustrating a two bearing embodiment of Applicant's novel device.

FIG. 23 shows a two bearing version with bearings, the bearing standards engaged with the axle, and having the rotor assembly (housing and base not shown) and motor between the two bearings. There is less vibration down the shaft and any residual vibration is less in the two bearing embodiments and shaft/bearing alignment problems are eliminated. Also by having only two bearings, it typically becomes easier to dynamically balance the shaft. The axle may also be split and coupled with a flexible coupler that can damp the vibration. It can also reduce the noise level. Using a split shaft coupler (see FIG. 22) will allow the motor rotor and disc rotor to be balanced separately and then connected after balancing via the standards.

Figure 24:
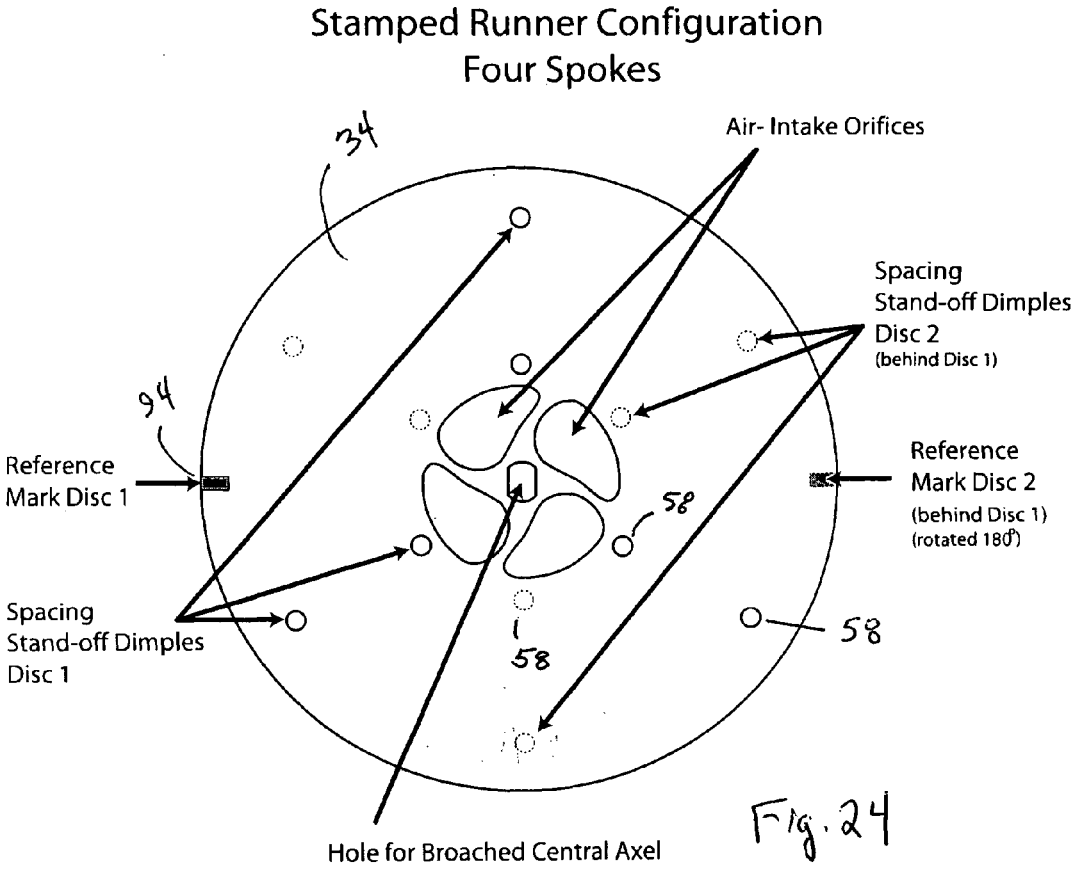
FIG. 24 illustrates an elevational side view of a disc or rotor in an alternate preferred embodiment having four spokes, wherein the spokes are the same thickness as the runner portion and dimples or standoffs are used spaced apart from an identical pattern on an adjacent rotor.

FIG. 24 illustrates a four spoke configuration of a rotor 34, including standoffs 58. Others are shown ghosted, for the rotor underneath the other. The top rotor is seen to have two sets of standoffs; one of the first radius and the second set at a second radius greater than the first radius. Beneath the top rotor is the second rotor with the same pattern, except rotated 180°. Furthermore it may be seen that the axle is broached so that disc 1 and disc 2 may be punched out of the same stamp, but rotated one with respect to the other 180° as they are inserted on the axle, which rotation would help balance out any defects in the manufacture of the stamped rotor. There may be that a reference mark 94 is provided to ensure each disc is rotated 180° with respect to the adjacent disc. In this particular preferred embodiment, four rather than three spokes are used in order to make sure the intake orifices line up with the alternating 180° alternating assembly. Note that the standoff spacing is 120° to the next and, in this way, the alternating assembly means most standoffs on a touching disc will line up with each other, thus the spacing function of the standoffs is preserved.

Also illustrated in FIG. 24, the function of the spacers 47 or thicker spokes may be supplanted by the use of dimples or standoff 58 stamped into the runner 34 in the case of a stamped metal disc or injection-molded onto the disc in the case of injection molding of the disc rotors. These standoffs may be in lieu of spacers 47 or thicker spokes. Such discs 34 would have to be fused or welded to each other at the dimples or standoffs 58 and to the axle 46. This use of standoffs is especially helpful when the rotor/stack assembly is glued or welded to the axle.

In the case of metal die-cut rotors 34, the thickness of the dimples/standoffs 58 can be variably set in the die itself. Thus one die can be set to deliver precisely variable interdisc spacing, and thus can deliver many different variations. This should make producing turbine pump variations far more cost-effective to produce.

In the case of even-numbers of spokes on a disc 34, a reference mark 94 may be added by stamping or injection molding, and its purpose would be to ensure a 180° alternate alignment between discs. Such an alignment would be useful in cancelling any imbalance caused by eccentric placement of the axel opening 42 when alternate) (180° alignment between discs is used throughout the rotor stack 32. This ensures a more balanced rotor stack 32. Standoffs may be punched or dimpled out of the rotor material as by stamping. In such a case, a depression may exist behind the standoff. Therefore, standoffs on adjacent discs should be staggered and balanced. This is achieved in the odd number of standoffs (here, three) in each "ring" (here, two).

In one manner, the fusing of the rotors to one another may be by a process of electrical flash welding and inert gas (such as argon). The set of discs may be assembled on their axle and placed under compression such that all standoffs touch an adjacent disc. An anode electrode may touch all discs at the periphery while a cathode may be attached to the axle. When this assembly is immersed in argon or other inert gas and the appropriate welding electrically discharge is applied, effective inert gas spot welding of the standoffs that are adjacent the discs may occur instantaneously and result in rapid and rigid construction of the disc set on the axle.

Although the invention has been described in connection with the preferred embodiment, it is not intended to limit the invention's particular form set forth, but on the contrary, it is intended to cover such alterations, modifications, and equivalences that may be included in the spirit and scope of the invention as defined by the appended claims.

The invention claimed is:

1. A bladeless pump comprising:

a rotor housing, including walls defining a volute, the volute having a knife edge, a volute fluid outlet, and walls defining a rotor feed opening;

fluid inlet walls, including walls defining a fluid inlet and passageway walls for carrying fluid from the fluid inlet to the rotor feed opening;

a rotor assembly, including a multiplicity of rotors, each rotor having a runner portion, the runner portion having a first thickness T1, walls defining a multiplicity of central openings, and a multiplicity of spokes, the spokes including walls defining an axle opening, the spokes having a second thickness T2, the second thickness greater than the first thickness Ti;

an axle; and a retaining collar; and wherein the rotors engage on the axle;

wherein the rotor housing substantially encloses the runner portions of the rotor assembly; and wherein the spokes of the rotors include alignment locking means.

2. The bladeless pump of claim 1, wherein the alignment locking means includes projecting pins and pin receiving indentations.

3. The bladeless pump of claim 2, wherein the spokes of the rotors contain pins having a first shape and pins having a second shape with corresponding receiving indentations having substantially matching receiving shapes.

4. A bladeless pump comprising:

a rotor housing, including walls defining a volute, the volute having a knife edge, a volute fluid outlet, and walls defining a rotor feed opening;

fluid inlet walls, including walls defining a fluid inlet and passageway walls for carrying fluid from the fluid inlet to the rotor feed opening;

a rotor assembly, including a multiplicity of rotors, each rotor having a runner portion, the runner portion having a first thickness T1, walls defining a multiplicity of central openings, and a multiplicity of spokes, the spokes including walls defining an axle opening, the spokes having a second thickness T2, the second thickness greater than the first thickness Ti;

an axle; and a retaining collar; and wherein the rotors engage on the axle;

wherein the rotor housing substantially encloses the runner portions of the stack rotor assembly; and wherein the endplates are planer, conical or labyrinthine shaped.

5. The bladeless pump of claim 4, wherein the endplates are connected to the retaining collar with fan-like struts.

6. A bladeless pump comprising:

a rotor housing, including walls defining a volute, the volute having a knife edge, a volute fluid outlet, and walls defining a rotor feed opening;

fluid inlet walls, including walls defining a fluid inlet and passageway walls for carrying fluid from the fluid inlet to the rotor feed opening;

a rotor assembly, including a multiplicity of rotors, each rotor having a runner portion, the runner portion having a first thickness T1, walls defining a multiplicity of central openings, and a multiplicity of spokes, the spokes including walls defining an axle opening, the spokes having a second thickness T2, the second thickness greater than the first thickness Ti;

an axle; and a retaining collar; and wherein the rotors engage on the axle;

wherein the rotor housing substantially encloses the runner portions of the stack rotor assembly; and further including a motor and a bearing to align the axle with the rotor housing and the stack assembly;

wherein the bearing is substantially in the plane of the walls adjacent the rotor feed opening.

7. A bladeless pump comprising:

a rotor housing, including walls defining a volute, the volute having a knife edge, a volute fluid outlet, and walls defining a rotor feed opening;

fluid inlet walls, including walls defining a fluid inlet and passageway walls for carrying fluid from the fluid inlet to the rotor feed opening;

a rotor assembly, including a multiplicity of rotors, each rotor having a runner portion, the runner portion having a first thickness T1, walls defining a multiplicity of central openings, and a multiplicity of spokes, the spokes including walls defining an axle opening, the spokes having a second thickness T2, the second thickness greater than the first thickness Ti;

an axle; and a retaining collar; and wherein the rotors engage on the axle;

wherein the rotor housing substantially encloses the runner portions of the stack rotor assembly; and further including a motor and a bearing to align the axle with the rotor housing and the stack assembly;

wherein the bearing includes a bearing spaced apart from the rotor feed opening on struts, the rotor feed opening on straight vanes, or the rotor feed opening on vortex vanes.

8. A bladeless pump comprising:

a rotor housing, including walls defining a volute, the volute having a knife edge, a volute fluid outlet, and walls defining a rotor feed opening;

fluid inlet walls, including walls defining a fluid inlet and passageway walls for carrying fluid from the fluid inlet to the rotor feed opening;

a rotor assembly, including a multiplicity of rotors, each rotor having a runner portion, the runner portion having a first thickness T1, walls defining a multiplicity of central openings, and a multiplicity of spokes, the spokes including walls defining an axle opening, the spokes having a second thickness T2, the second thickness greater than the first thickness Ti;

an axle;

a retaining collar;

wherein the rotors engage on the axle;

wherein the rotor housing substantially encloses the runner portions of the stack rotor assembly;

further including a motor; and further including a cover, a base, a motor standard, and bearing standards, the base for engagement with the rotor housing, the motor standard, the bearing standards, and the cover.

9. A bladeless pump comprising:

a rotor housing, including walls defining a volute, the volute having a knife edge, a volute fluid outlet, and walls defining a rotor feed opening;

fluid inlet walls, including walls defining a fluid inlet and passageway walls for carrying fluid from the fluid inlet to the rotor feed opening;

a rotor assembly, including a multiplicity of rotors, each rotor having a runner portion, the runner portion having a first thickness T1, walls defining a multiplicity of central openings, and a multiplicity of spokes, the spokes including walls defining an axle opening, the spokes having a second thickness T2, the second thickness greater than the first thickness Ti;

an axle;

a retaining collar;

wherein the rotors engage on the axle;

wherein the rotor housing substantially encloses the runner portions of the stack rotor assembly;

further including a motor; and further including means to carry a fluid from walls defining the volute to the stack rotor assembly.

10. A bladeless pump comprising:

a rotor housing, including walls defining a volute, the volute having a knife edge, a volute fluid outlet, and walls defining a rotor feed opening;

fluid inlet walls, including walls defining a fluid inlet and passageway walls for carrying fluid from the fluid inlet to the rotor feed opening;

a rotor assembly, including a multiplicity of rotors, each rotor having a runner portion, the runner portion having a first thickness T1, walls defining a multiplicity of central openings, and a multiplicity of spokes, the spokes including walls defining an axle opening, the spokes having a second thickness T2, the second thickness greater than the first thickness Ti;

an axle;

a retaining collar; and wherein the rotors engage on the axle;

wherein the rotor housing substantially encloses the runner portions of the stack rotor assembly; and further including a motor and a moter standard;

wherein the motor standard is hermetically sealed from the fluid inlet walls.

11. A bladeless pump comprising:

a rotor housing, including walls defining a volute, the volute having a knife edge, a volute fluid outlet, and walls defining a rotor feed opening;

fluid inlet walls, including walls defining a fluid inlet and passageway walls for carrying fluid from the fluid inlet to the rotor feed opening;

a rotor assembly, including a multiplicity of rotors, each rotor having a runner portion, the runner portion having a first thickness T1, walls defining a multiplicity of central openings, and a multiplicity of spokes, the spokes including walls defining an axle opening, the spokes having a second thickness T2, the second thickness greater than the first thickness Ti;

an axle;

a retaining collar; and wherein the rotors engage on the axle;

wherein the rotor housing substantially encloses the runner portions of the stack rotor assembly and wherein the fluid inlet walls engage the turbine rotor housing so as receiving fluid from rotor feed opening; and further including a motor engaged with the axle to drive the stack assembly, a motor housing, a base to support the motor, motor standard, bearing standards, and rotor housing, and a cover hermetically sealed to the base, motor standard, bearing standards, and rotor housing.

* * * * *